US006612678B2

(12) United States Patent
Kato et al.

(10) Patent No.: US 6,612,678 B2
(45) Date of Patent: Sep. 2, 2003

(54) INK JET PRINTING SYSTEM AND METHOD

(75) Inventors: Masao Kato, Tochigi (JP); Akitoshi Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/944,183

(22) Filed: Sep. 4, 2001

(65) Prior Publication Data

US 2002/0027572 A1 Mar. 7, 2002

(30) Foreign Application Priority Data

Sep. 4, 2000 (JP) ..... 2000-267816

(51) Int. Cl.[7] ..... B41J 29/393
(52) U.S. Cl. ..... 347/19; 347/14
(58) Field of Search ..... 347/19, 43, 15, 347/5, 9, 10, 11, 14

(56) References Cited

U.S. PATENT DOCUMENTS

| | | | | |
|---|---|---|---|---|
| 4,723,129 A | | 2/1988 | Endo et al. | 347/9 |
| 5,739,828 A | | 4/1998 | Moriyama et al. | 347/14 |
| 6,293,644 B1 | * | 9/2001 | Markham et al. | 347/19 |

FOREIGN PATENT DOCUMENTS

| | | |
|---|---|---|
| JP | 2000-127459 | 5/2000 |

* cited by examiner

*Primary Examiner*—Lamson Nguyen
(74) *Attorney, Agent, or Firm*—Fitzpatrick, Cella, Harper & Scinto

(57) ABSTRACT

A ink jet printing system includes an ink jet head from which is discharged to form an image on a recording medium, an ink jet apparatus provided with a conveyer means for conveying the recorded medium, and a casing for scanning the ink jet head in the main or horizontal scanning direction intersecting the conveying direction of the recording medium, and a printer driver for creating image information to be output to the ink jet apparatus on the basis of density information. According to the present invention, the ink jet system comprises: an image information detecting section for receiving first image information to detect whether the first image information is seriously damaged due to detrimental effects of satellite dots; and an image information changing section for changing information to be used, if it is detected that the first image information is seriously damaged due to detrimental effects of satellite dots, from the first image information to second image information less influenced by the satellite dots than the first image information.

22 Claims, 17 Drawing Sheets

FIG. 9A

| | | | |
|---|---|---|---|
| 10 | 6 | 6 | 11 |
| 5 | 2 | 2 | 8 |
| 7 | 4 | 4 | 7 |
| 9 | 8 | 8 | 12 |

PATTERN HAVING FATTING CHARACTERISTIC

FIG. 9B

| | | | |
|---|---|---|---|
| 2 | 2 | 6 | 6 |
| 10 | 10 | 14 | 14 |
| 8 | 8 | 4 | 4 |
| 16 | 16 | 12 | 12 |

PATTERN HAVING BAYER CHARACTERISTIC

INK JET PRINTING SYSTEM AND METHOD

BACKGROUND OF THE INVENTION

1. Field of the Invention

The present invention relates to an ink jet printing system and a method provided with an ink-jet print head for discharging ink by generating bubbles with the application of thermal energy.

According to the present invention, the term "printing" or "print" means that not only figurative or meaningful images such as characters and figures, but also nonfigurative images or images that do not communicate meaning such as patterns are formed on printed media.

Further, the term "printing apparatus" or "printer" used in the following description of the specification indicates an ink jet printer.

2. Description of the Related Art

Conventionally, there has been known as an ink jet printing method, a so-called bubble jet printing method, which applies thermal energy to ink in each of ink flow paths in a printing apparatus such as a printer to generate a bubble. As a result, the ink is discharged from each of discharge ports by an abrupt volumetric change associated with the formation of the bubble. A droplet of ink discharged is made to adhere to the surface of a printed medium so that an image will be formed thereon. One of the printing apparatuses using the above-mentioned bubble jet printing methods is disclosed in U.S. Pat. No. 4,723,129. This patent teaches a bubble jet printing apparatus, which is typically provided with discharge ports for discharging ink, liquid flow paths communicating with the respective discharge ports, and electrothermal converting elements arranged in the respective liquid flow paths as energy generating means for discharging the ink.

This type of printing method enables the printing apparatus to print out high-quality images at high speeds and low noise levels. In addition, a print head using this type of printing method arranges discharge ports in a compact apparatus more densely, which makes it easy to obtain a high-resolution printed image even though it is a color image. Thus, since the bubble jet printing method has lots of advantageous points, it has recently been employed for not only many office equipment, such as printers, copiers and facsimiles, but also industrial systems such as apparatuses used at printworks.

As the application of bubble jet technology expands to a wide range of products, various demands for the technology have been increasing through the years.

For example, to obtain a high-quality image, proper driving conditions have been proposed so that they can realize an ink discharging method capable of discharging ink properly at high speed under the influence of stable bubble generation. Further, from the high-speed print's point of view, improvements in the shape of a liquid flow path have been proposed to obtain an ink-jet print head capable of speeding up a refill of ink into the liquid flow path from which an amount of ink has been discharged.

It has conventionally been known that the front portion of a bubble generated by film boiling (of an edge shooting type) has a major impact on discharging of ink, but no attention is paid to a technique for efficiently using this portion to form discharged droplets. The inventors have carefully studied to solve technical problems on this matter.

Paying attention to the relationship between displacement or deformation of a movable member and generation of a bubble, the inventors acquired the following findings.

One of the findings is that a stopper can control the displacement of a free end of the movable member relative to the growth of a bubble. The stopper restricts the displacement of the movable member, which in turn restricts the growth of the bubble on the upstream side of the liquid flow path to transmit energy to the downstream side on which the discharge port is formed, thereby efficiently discharging ink.

The above-mentioned ink-jet print head discharges ink droplets nearly in the form of liquid columns with bulb-like tips at the instant of discharging the ink from the discharge ports due to generation of bubbles, respectively. The same phenomenon happens to a conventional head structure, but the ink-jet print head having such a movable member displaces or deforms the movable member in the process of growing a bubble. Then, when the movable member thus displaced comes in contact with the stopper, a substantially closed space is formed in the liquid flow path except the discharge port. Since the closed space is maintained until the bubble disappears and hence the movable member is separated from the stopper, energy generated by bubble disappearance serves as such a force as to move ink near the discharge port in the upstream direction. As a result, an ink interface or meniscus is rapidly pulled into the liquid flow path from the discharge port just after the bubble disappearance is started. Then, a tail portion connected with a discharged droplet outside of the discharge port to form part of a liquid column is cut off in a flash by a strong pulling force of the meniscus. This makes it possible to minimize generation of a satellite particle formed from the tail portion, and hence improve print quality.

Although the meniscus is rapidly pulled in, this phenomenon does not continue to pull the tail portion, which prevents reduction in the discharging speed. Further, since distance between the discharged droplet and the satellite particle becomes short, the satellite particle is attracted to the discharged droplet by means of so-called slipstream behind the discharged droplet. As a result, the discharged droplet and the satellite droplet could become united, which makes it possible to reduce image quality degradation.

To make image quality higher, the ink-jet print head having the above-mentioned movable member is further required to reduce image quality degradation caused by satellite droplets conspicuous at single-dot printing. In carefully studying this matter, the applicant acquired the following novel knowledge:

1. It is essential to manage or control physical properties of ink such as viscosity and surface tension, reduction in design flexibility such as a layout of the head nozzles or driving method, and a manufacturing tolerances.
2. Many satellite droplets tend to take place unevenly in only one direction, not in all scanning directions of a carriage.

SUMMARY OF THE INVENTION

The present invention has been made in view of the above-mentioned facts, and an object thereof is to provide ink jet printing system and method capable of reduce the degradation of printed images due to satellite droplets.

In attaining the above-mentioned object and according to the present invention, there is provided an ink jet printing system constituted of an ink jet printing apparatus and a printer driver. The ink jet printing apparatus includes an ink jet head from which ink is so discharged that an image will be printed out on a recorded medium, conveying means for conveying the recorded medium, and a holding means for keeping the ink jet head reciprocating in the main or horizontal scanning direction intersecting the conveying direction of the recording medium. The printer driver creates image information in an information processing apparatus on the basis of density information. The ink jet printing system according to the present invention comprises image information detecting means and image information changing means. The image information detecting means receives first image information to detect whether the first image information represents an image prone to significant degradation due to detrimental effects of satellite dots. The image information changing means changes information to be used, if it is detected that the first image information represents an image prone to significant degradation due to detrimental effects of satellite dots, from the first image information to second image information representing an image less influenced by the satellite dots than the first image information.

In the above-mentioned configuration of the ink jet printing system, when printing is to be made on the basis of the first print information on a single-dot print tending to generate satellite dots, only main droplets are discharged with adding the second print information continuously to the discharge of the main droplet based on the first print information. The second print information is information for generating not satellite dots. In this case, the changing means changes the print information composed of the first print information alone into the print information composed of the first print information and the second print information. In other words, main droplets discharged on the basis of the second print information are hit on respective satellite dots alighted adjacent to but slightly spaced with the main droplets discharged on the basis of the first print information, which makes the satellite dots inconspicuous.

The ink-jet print head may have a heating element for generating thermal energy to generate a bubble in an ink flow path. Alternatively, the ink-jet print head may have a movable member with a free end provided in a bubble generating region in the ink flow path communicating the discharge port, and displaced or deformed with the growth of the bubble.

According to the present invention, there is also provided an ink jet printing method for creating image information from density information, driving an ink jet head on the basis of the image information, and discharging ink to a recorded medium so that an image will be printed on the recorded medium. The ink jet printing method comprises the following two steps: one receiving first image information to detect whether the first image information represents an image prone to significant degradation due to detrimental effects of satellite dots, and the other changing image information to be used, if detected that the first image information represents an image prone to significant degradation due to detrimental effects of satellite dots, from the first image information to second image information less influenced by satellite dots than represented by the first image information.

In the above-mentioned ink jet printing method, two or more ink dots are continuously discharged in a continuous discharging process, which can reduce image quality degradation resulting from generation of satellite dots, especially noticeable in single-dot printing. The continuous discharging process may be carried out on a printer driver side in a host computer, or on the ink jet printing apparatus in which the inkjet print head is mounted.

The ink jet printing method may further comprising the step of creating print data indicative of an arrangement of continuous pixel data in the main or horizontal scanning direction, where each pixel corresponds to each dot hit on the printed medium.

BRIEF DESCRIPTION OF THE DRAWINGS

FIGS. 9A and 9B illustrate dither patterns created by a quantization technique according to a second embodiment of the present invention.

DESCRIPTION OF THE PREFERRED EMBODIMENTS (First Embodiment)

Figure 1:
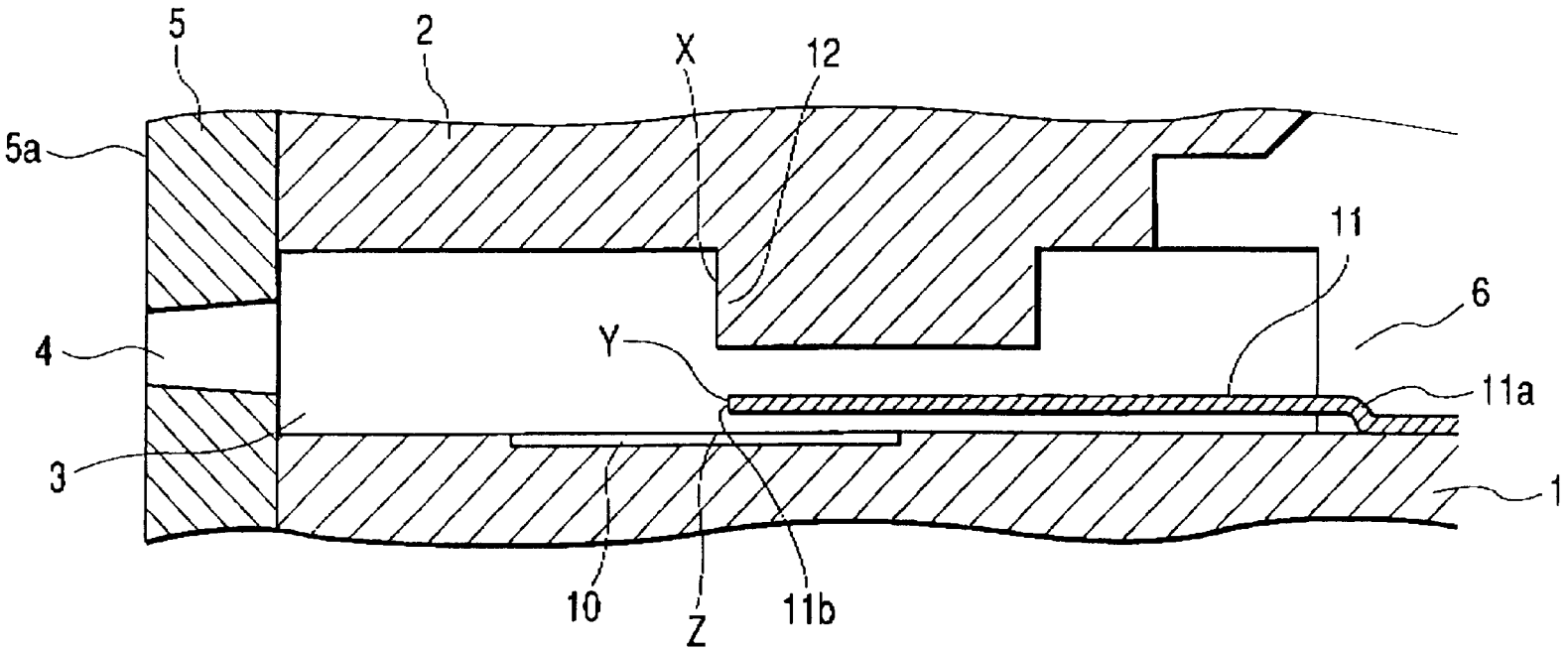
FIG. 1 is a side sectional view of the main part of an exemplary ink-jet print head in which a stopper is formed.

FIG. 1 is a side sectional view of the main part of an exemplary ink-jet print head properly mounted in an ink jet printing apparatus according to the embodiment.

Description will be made first about the structure of the ink-jet print head with reference to FIG. 1.

The ink-jet print head includes a substantially flat device substrate 1 having a heating element 10 as bubble generating means and a movable member 11, a top plate 2 with its groove portion forming a stopper 12, and an orifice plate 5 in which a discharge port 4 is formed.

A liquid flow path 3 through which ink flows is formed by fixing the device substrate 1 and the top plate 2 in the form of a laminate. A plurality of liquid flow paths 3 are formed in parallel with an inkjet print head so as to communicate with respective discharge ports 4 formed downstream (left side in FIG. 1) for discharging ink therefrom. A bubble generating region exists in the neighborhood of the surface on which the heading element 10 comes in contact with ink. Further, a large-capacity common liquid chamber 6 is formed upstream of the liquid flow paths 3 so that the liquid flow paths 3 communicate with the common liquid chamber 6 at the same time. In other words, each liquid flow path 3 is branched from the single common liquid chamber 6. The height of the common liquid chamber 6 is set higher than that of the liquid flow path 3.

The movable member 11 is a cantilever member supported at one end and fixed to the device substrate 1 upstream of the ink flow so that the downstream side from a fulcrum point 11*a* can be moved up and down with respect to the device substrate 1. In an initial state, the movable member 11 is located substantially in parallel with the device substrate 1 with a space between the movable member 11 and the device substrate 1.

The movable member 11 thus provided to the device substrate 1 is so arranged that a free end 11*b* is positioned substantially in a central region of the heating element 10. Further, the stopper 12 provided in the top plate 2 restricts an upward displacement or deformation of the free end 11*b* of the movable member 11 when it comes in contact with the stopper 12. When the stopper 12 comes in contact with the movable member 11 to restrict the displacement or deformation of the movable member 11 (at the time of contacting the movable member), the movable member 11 and the stopper 12 cooperate to close the liquid flow path 3. This phenomenon substantially divides the liquid flow path 3 into the upstream and downstream sides of the movable member 11 and the stopper 12.

It is preferable to even up an edge Y of the free end 11*b* and one end X of the stopper 12 on a plane perpendicular to the device substrate 1. It is further preferable to even up the edges X, Y, and a center Z of the healing element 10 on the plane perpendicular to the substrate.

The liquid flow path 3 is so formed that the downstream side from the stopper 12 rises sharply. Such a sharp rise in height can keep room in the liquid flow path enough to grow a bubble downstream of the bubble generating region even when the movement of the movable member 11 is restricted by the stopper 12. Therefore, a flow of ink can be smoothly moved toward the discharge port 4 without retarding the growth of the bubble. Further, unevenness of pressure balance in height from the lower end to the upper end of the discharge port 4 can be reduced, which ensures proper discharging of ink. If this configuration of the liquid flow path is adopted in a conventional ink-jet print head having no movable member 11, a stagnation will take place in such a portion of the liquid flow path that the height rises on the downstream side of the stopper 12. In this case, a bubble tends to stand in the stagnation, and this tendency is unfavorable for proper discharging of ink. In contrast, the embodiment makes the flow of ink reach up to the stagnation, which extremely reduces the effect of standing or dead bubbles.

If no movable member 11 is provided in the above-mentioned configuration, fluid resistance on the downstream side of the bubble generating region becomes lower than that on the upstream side, which makes it difficult to direct discharging pressure toward the discharge port 4. On the other hand, in the embodiment, the movable member 11 substantially blocks the movement of the bubble to the upstream side from the bubble generating region during bubble formation, which urges discharging pressure toward the discharge port 4. Further, the fluid resistance on the upstream side of the bubble generating region becomes low at the time of supplying ink, which results in a quick supply of ink to the bubble generating region.

The provision of the movable member 11 makes a downstream growing component and an upstream growing component of the bubble nonuniform so as to reduce the upstream growing component, and thereby restrict the movement o fink to the upstream side. Since the flow of ink to the upstream side is restricted, the amount of retrogression of the meniscus after discharging ink is reduced to reduce the amount of projection of the meniscus from the orifice surface 5*a* during refilling ink. Thus meniscus vibration is prevented so that stable discharge can be carried out at any driving frequency ranging from low frequency to high frequency.

In the embodiment, part of the liquid flow path between the downstream side of the bubble and the discharge port 4 is in a "linear communication state" in which the flow of liquid is kept moving straight ahead through the liquid flow path. It is further preferable that the propagation direction of a pressure wave produced by generation of the bubble, and directions of flowing and discharging ink associated with the propagation of the pressure wave linearly match with one another. This makes it possible to form such an ideal state that discharging conditions such as the direction and speed of a discharged droplet 66 to be described later are highly stabilized. To achieve or make an approximation to the ideal state, the embodiment defines such a simple configuration that the discharge port 4 and the heating element 10, especially the discharge port 4 side (downstream side) of the heating element 10 wielding influence over the bubble on the discharge port 4 side, are directly connected with each other in a straight line. In this configuration, the heating element 10, especially the downstream side of the heating element 10, can be observed as viewed from the outside of the discharge port 4 in such condition that the ink-jet print head has run out of ink.

Next, description will be made about a first discharge of ink from the ink-jet print head according to the embodiment, generation of a satellite droplet, and dot placements (hitting positions) of the first shot of ink droplet and the satellite droplet on a sheet with reference to FIGS. 2A to 2E. Then, hitting positions of a second shot of ink droplets on the sheet will be described with reference to FIGS. 3A to 3E. In these drawings, M denotes a moving direction of a carriage.

Figure 2A:
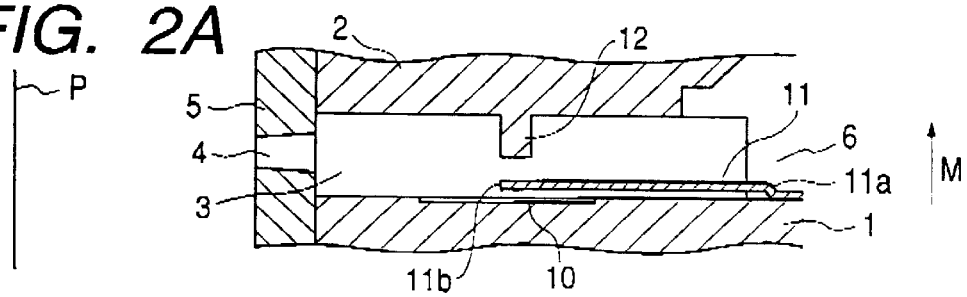
FIGS. 2A, 2B, 2C, 2D and 2E are side sectional views for explaining a first discharge of ink from the ink-jet print head shown in FIG. 1 and generation of a satellite dot.

FIG. 2A indicates a state of the print head before energy such as electric energy is applied to the heating element 10, that is, it indicates the state of the print head before the heating element 10 generates heat. In this state, the movable member 11 is placed in a position in which the movable member 11 will face half the upstream side of a bubble generated by heat from the heating element as described later. The carriage with the ink-jet print head mounted thereon is moving upward in FIGS. 2A to 2E.

Figure 2B:
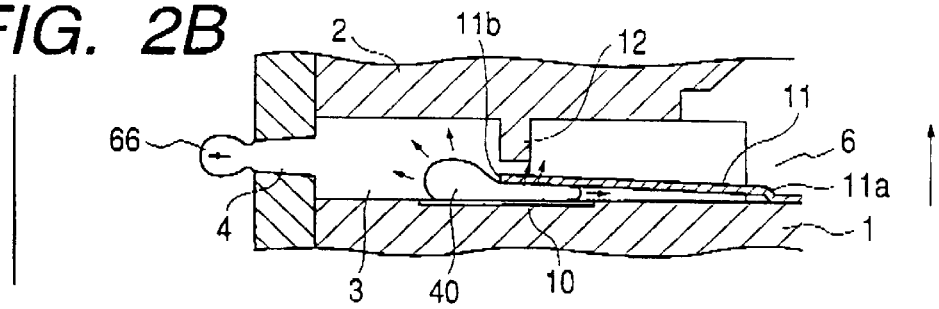

FIG. 2B indicates a state just after a bubble 40 starts bubbling due to film boiling by the application of heat from the heating element 10 to part of ink. In other words, a pressure wave produced by generating the bubble 40 due to film boiling is propagated through the liquid flow path. With propagation of the pressure wave, the flow of ink is branched to downstream and upstream sides across a demarcation line around the center of the bubble generating region. The flow of ink on the upstream side causes the movable member 11 to be deformed with the growth of the bubble 40. Further, the upstream movement of the ink is directed to the common liquid chamber 6 through a gap or clearance between the inner wall of the liquid flow path 3 and the movable member 11. As the movable member 11 is deformed, the clearance between the stopper 12 and the movable member 11 becomes narrower. Under this condition, a discharge of the discharged droplet 66 is started from the discharge port 4.

Figure 2C:
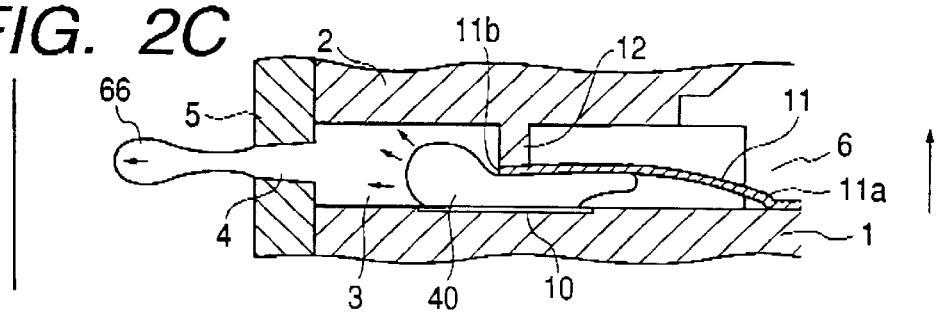

FIG. 2C indicates a state at the time the free end 11*b* of the movable member 11 displaced or deformed with further growth of the bubble 40 comes in contact with the stopper 12.

The movable member 11 comes in closer proximity to and in contact with the stopper 12. In this case, the height of the stopper 12 and the clearance between the upper surface of the movable member 11 and the end portion of the stopper 12 are set to desired dimensions, which makes sure of the timing of contacting the movable member 11 with the stopper 12. Once the movable member 11 has come in contact with the stopper 12, the free end 11*b* is inhibited from further deforming upward to largely restrict the upstream movement of the ink. The growth of the bubble 40 to the upstream side is also restricted by the movable member 11. At this time, since the moving force of the ink in the upstream direction becomes large, such a stress as to pull the movable member 11 in the upstream direction is exerted on the movable member 11 to cause the middle portion of the movable member 11 to be deformed in a convex shape. Although the bubble 40 remains growing, the stopper 12 and the movable member 11 restrict the growth of the bubble 40 to the upstream side, resulting in further growth of the bubble 40 to the downstream side. In other words, the height of the bubble 40 on the downstream side from the heating element 10 becomes higher than that in a case where no movable member 11 is provided.

On the other hand, since the displacement or deformation of the movable member 11 is restricted by the stopper 12, the upstream side of the bubble 40 does not grow so much. The dimensions of the upstream side of the bubble 40 are kept so small that an inertia force of the flow of ink to the upstream side only puts stress on the movable member 11 to bend the same to the upstream side in the convex shape. The upstream portion of the bubble 40 is restricted by the stopper 12, the nozzle walls, the movable member 11 and the fulcrum point 11*a*, so that the amount of ink flowing into the upstream region is reduced to almost zero.

Thus the liquid flow to the upstream side is considerably restricted to prevent a reverse flow of the liquid to the liquid supply path or pressure vibration so as to prevent an interruption of a high-speed refill of the liquid.

Figure 2D:
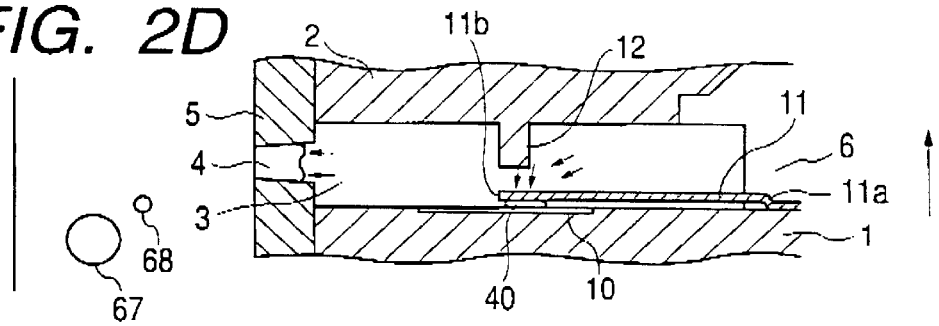

FIG. 2D indicates a state of the print head when inner negative pressure of the bubble 40, generated as described above after film boiling, exceeds the downstream movement of the ink in the liquid flow path 3 to start contracting.

As the bubble 40 contracts, the movable member 11 is displaced downward. The downward displacement of the movable member 11 is accelerated by cantilever stress of the movable member 11 itself and the above-mentioned stress that causes the movable member 11 to be displaced upward in the convex shape. At this time, the downstream flow of the ink has low flow resistance on the upstream side of the movable member 11, that is, in a low-resistance flow-path region formed between the common liquid chamber 6 and the liquid flow path 3. As a result, a large flow of ink rushes into the liquid flow path 3 through the stopper 12 to lead the ink from the common liquid chamber 6 into the liquid flow path 3. The ink led into the liquid flow path 3 passes through the clearance between the stopper 12 and the downward displaced movable member 11 as it is to flow into the downstream side of the heating element 10 while accelerating complete disappearance or extinction of the bubble 40. This flow of the ink helps the extinction of the bubble to make a further flow of ink toward the discharge port 4, which helps the meniscus recovery to improve refilling speed.

At this stage, the liquid column together with the discharged droplet 66 going out of the discharge port 4 forms a main droplet 67 discharged to the outside. Discharge of the main droplet 67, however, runs the danger of tearing off the tail end of the main droplet 67 during discharge to cause a satellite droplet of droplets to separately hit the printed medium.

Further, the above-mentioned flow of ink into the liquid flow path 3 through the clearance between the movable member 11 and the stopper 12 accelerates the velocity of flow along the wall surface of the top plate 2. As a result, residual fine bubbles generated in this portion are extremely reduced, contributing to stable discharging.

Further, cavitation resulting from extinction of the bubble occurs at a point deviated from the bubble generating region in a downstream direction, so that damage to the heating element 10 can be reduced. This phenomenon can also reduce adherence of burnt deposits to the heating element 10 to improve stability in the discharging process.

Figure 2E:
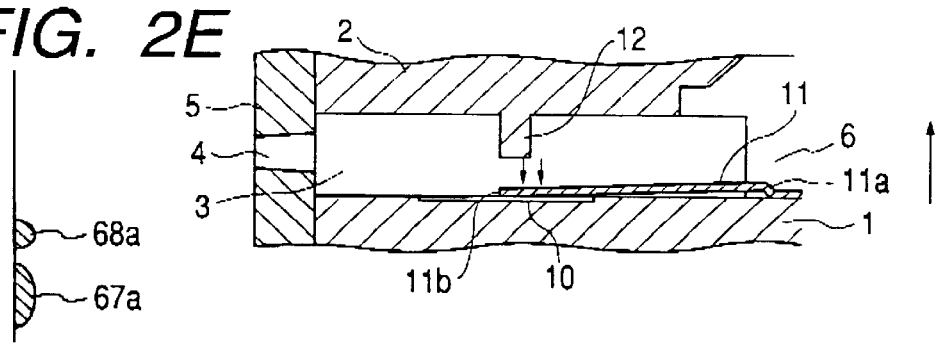

FIG. 2E indicates a state where the movable member 11 is overshot and displaced downward from its initial state after the bubble 40 has completely disappeared.

The overshoot of the movable member 11 will become weak and be settled in a short time to return to the initial state, depending on the stiffness of the movable member 11 and the viscosity of the ink.

On the other hand, the main droplet 67 and the satellite droplet 68 hit the sheet surface to form a main dot 67*a* and a satellite dot 68*a*. The generation of the satellite droplet 68 in single-dot printing makes the hitting position of the satellite dot 68*a* separated from the hitting position of the main dot 67*a*, and hence the satellite dot 68*a* conspicuous.

Figure 3A:
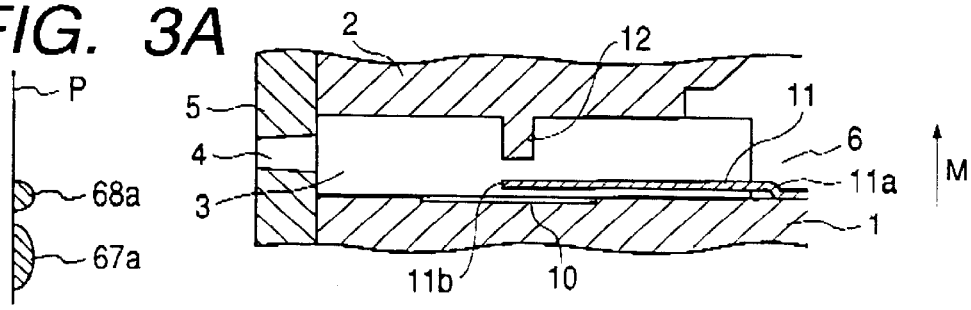
FIGS. 3A, 3B, 3C, 3D and 3E are side sectional views for explaining a second discharge of ink following the first shot.
Figure 3B:
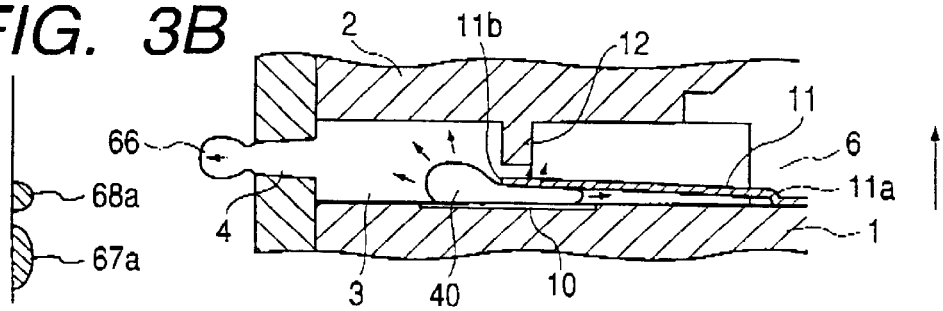
Figure 3C:
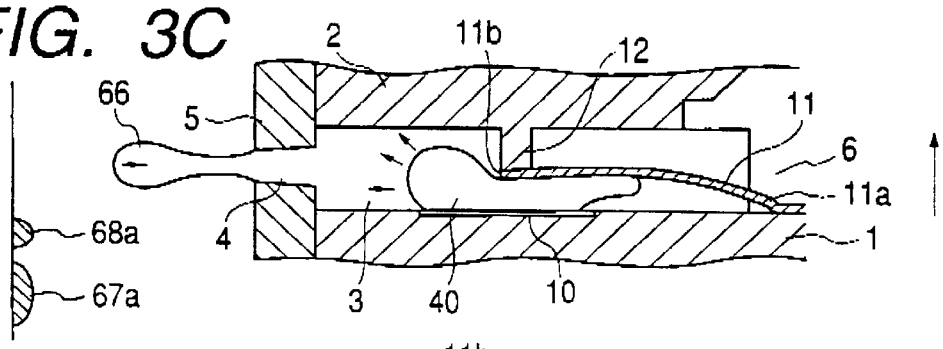
Figure 3D:
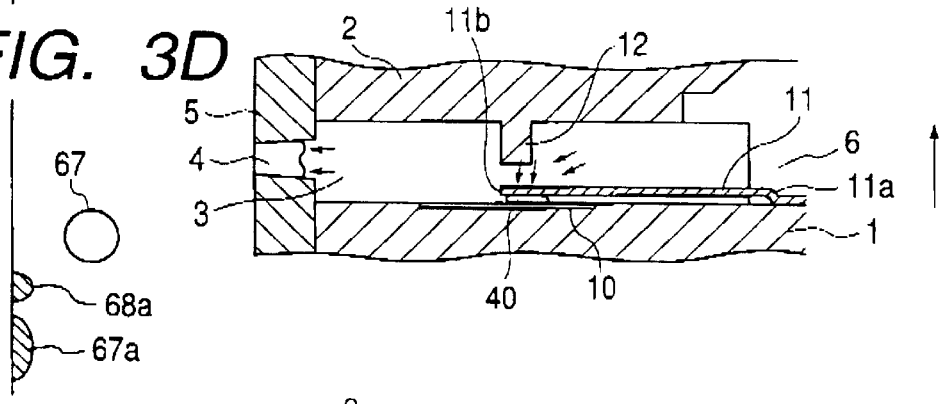
Figure 3E:
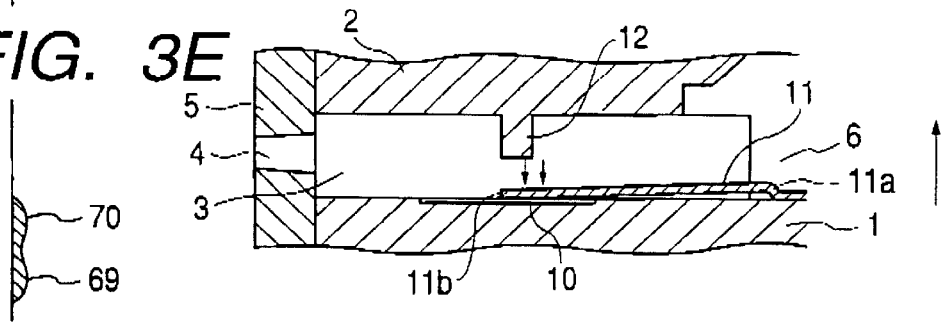

Following the first shot of ink through the sequence of discharging operations from FIGS. 2A to 2E, a second shot of ink is discharged in the same manner through a sequence of discharging operations from FIGS. 3A to 3E. In the process of discharging the second shot of ink following the first shot, however, the satellite droplet can catch up with the main droplet 67 during discharge as shown in FIG. 3D. As a result, only the main droplet is hit on the printed medium without generation of any satellite dot on the image. Further, as shown in FIG. 3E, the second shot of the droplet forms a second dot 70 adjacent to the first dot 69 on the sheet surface to form a united dot.

Figure 4:
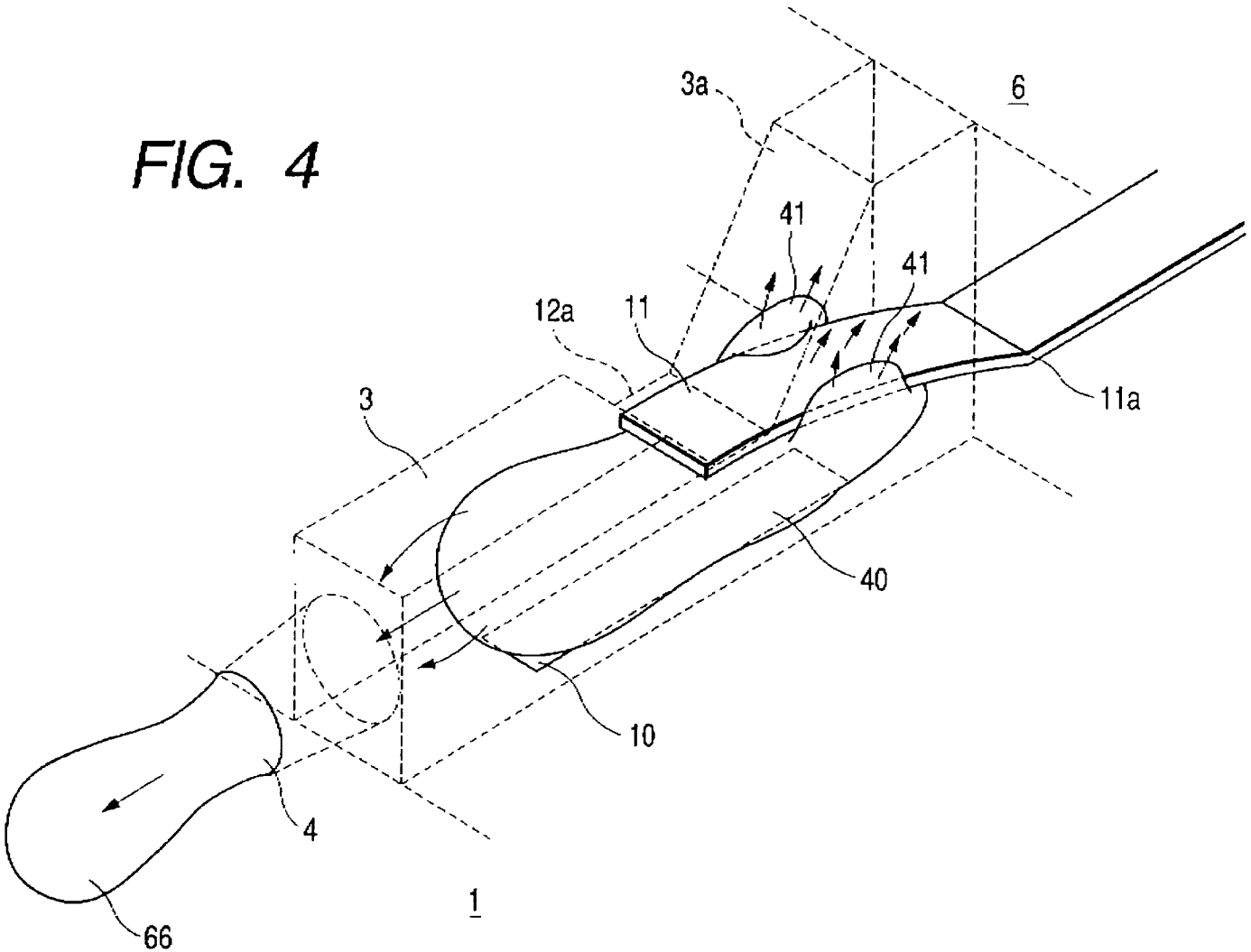
FIG. 4 is a perspective view of part of the head shown in FIG. 1.

FIG. 4 is a perspective view of part of the head shown in FIG. 1. Referring next to FIG. 4, projecting bubble portions 41 of the bubble 40 rising from both sides of the movable member 11 and the meniscus of ink in the discharge port 4 will be described in detail. Although the shape of the stopper 12 and the shape of the low-resistance flow-path region 3*a* shown in FIG. 4 are different from those shown in FIG. 1, basic characteristics are the same as those described above.

In the embodiment, there are slight clearances between surfaces of both side walls constituting the liquid flaw path 3 and both sides of the movable member 11, and these slight clearances allow a smooth displacement or deformation of the movable member 11. Further, in the process of growing the bubble by means of the heating element 10, the bubble 40 displaces or deforms the movable member 11 while rising from the upper surface of the movable member 11 through the clearances and slightly breaking into the low-resistance flow-path region 3*a*. The projecting bubble portions 41 of the bubble rising from the upper surface of the movable member 11 and breaking into the low-resistance flow-path region 3*a* passes around behind the back surface (the surface opposite to the bubble generating region) of the movable member 11. This makes it possible to prevent the movable member 11 from shaking, and hence stabilize the discharging characteristics.

Further, in the process of making the bubble 40 extinct, the projecting bubble portions 41 of the bubble 40 promote the flow of the liquid from the low-resistance flow-path region 3*a* to the bubble generating region. As a result, bubble disappearance is promptly completed along with high-speed pulling of the meniscus from the discharge port 4. Particularly, the liquid flow caused by the projecting bubble portions 41 makes it difficult to leave part of the bubble around the movable member 11 or in the corners of the liquid flow path 3.

In the above-mentioned configuration of the ink-jet print head, the discharged droplet 66 is discharged nearly in the form of a liquid column with a bulb-like tip at the instant of discharging the ink from the discharge port 4 due to generation of the bubble 40. This phenomenon also occurs in the conventional head, but the present invention differs from the conventional in that the movable member 11 is displaced or deformed with the growth of the bubble. Then the movable member 11 displaced comes in contact with the stopper 12 to form a substantially closed space in the liquid flow path 3 having the bubble generating region except the discharge port. Since the closed space is maintained until the bubble disappears and hence the movable member 11 is separated from the stopper 12, energy generated by the bubble disappearance mostly serves as such a force as to move the ink near the discharge port in the upstream direction. As a result, the meniscus is rapidly pulled into the liquid flow path 3 from the discharge port 4 just after the bubble disappearance is started. Subsequently, a tail portion connected with the discharged droplet 66 outside the discharge port 4 to form part of the liquid column is cut off in a flash by a strong pulling force of the meniscus. This makes it possible to reduce the size of the satellite droplet 68 formed from the tail portion. In this case, however, there is a danger of forming a dot on the printed medium from the satellite droplet 68 unevenly in only one direction, not in all scanning directions of a carriage HC, as will be described later, depending on the design of the print head.

It should be noted that in the embodiment the movable member 11 is provided in the above-mentioned ink-jet print head for restricting only part of the bubble 40 that grows upstream against the flow of ink toward the discharge port 4. However, it is further preferable to position the free end 11*b* of the movable member 11 substantially in the central portion of the bubble generating region. In this configuration, a back wave to the upstream side and an inertia force generated with the growth of the bubble bat not directly related to an discharge of ink can be prevented while directing the downstream component of the bubble 40 to the discharge port 4 as it is.

Further, since the low-resistance flow-path region 3*a* opposite to the discharge port 4 across the stopper 12 as the boundary has a low flow resistance, the low-resistance flow-path region 3*a* causes a large flow of ink in the upstream direction with the growth of the bubble 40. Therefore, when the displaced movable member 11 comes in contact with the stopper 12, a stress sufficient to pull the movable member 11 in the upstream direction is exerted on the movable member 11. As a result, a force able to move the ink upstream with the growth of the bubble 40 remains influential until repulsion of the movable member 11 exceeds the force t move the ink, thereby maintaining the above-mentioned closed space for a fixed period of time. In other words, when repulsion of the movable member 11 exceeds the force needed to move the ink upstream with the growth of the bubble in the process of making the bubble 40 extinct, the movable member 11 is displaced or deformed downward to return to its initial state. As the movable member 11 is displaced or deformed downward, a downstream flow occurs even in the low-resistance flow-path region 3*a*. Since the downstream flow in the low-resistance flow-path region 3*a* has a low flow resistance, a large flow rushes into the liquid flow path 3 through the stopper 12. As a result, the downstream movement of the ink toward the discharge port 4 applies a sudden brake to the pulling of the meniscus into the liquid flow path 3, which makes it possible to settle the meniscus vibration at high speed.

Figure 5:
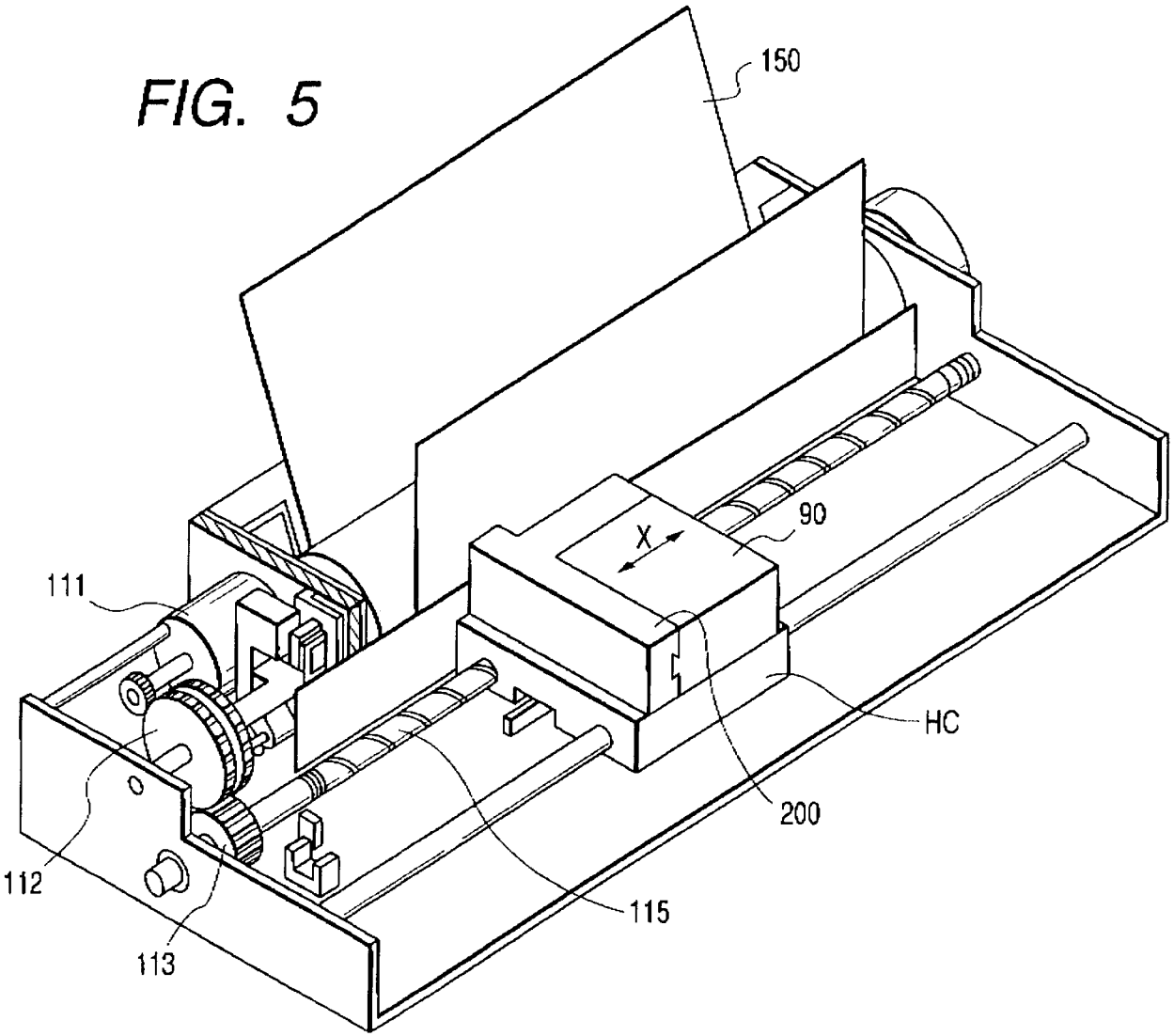
FIG. 5 is a schematic perspective view illustrating an example of an ink jet printing apparatus.

FIG. 5 is a schematic perspective view of an exemplary ink jet printing apparatus in which the above-mentioned ink-jet print head is incorporated. In FIG. 5, the carriage IIC is equipped with an ink tank 90 for storing ink and a head cartridge from which the ink-jet print head 200 is removable. The carriage HC reciprocates in the main or horizontal scanning direction (the direction of arrow Y in FIG. 5) corresponding to the wide direction of a printed medium 150 such as printing paper conveyed by the printed-medium conveying means.

When a driving signal is supplied from driving-signal supplying means, not shown, to ink discharging means on the carriage HC, ink is discharged from the discharge ports 4 of the ink-jet print head 200 to the printed medium 150.

In the embodiment, the ink-jet printing apparatus includes a motor 111 as a driving source for driving the carriage HC as the printed-medium conveying means, gears 112, 113 for transmitting power from the driving source to the carriage HC, a carriage shaft 115, and the like.

Figure 6:
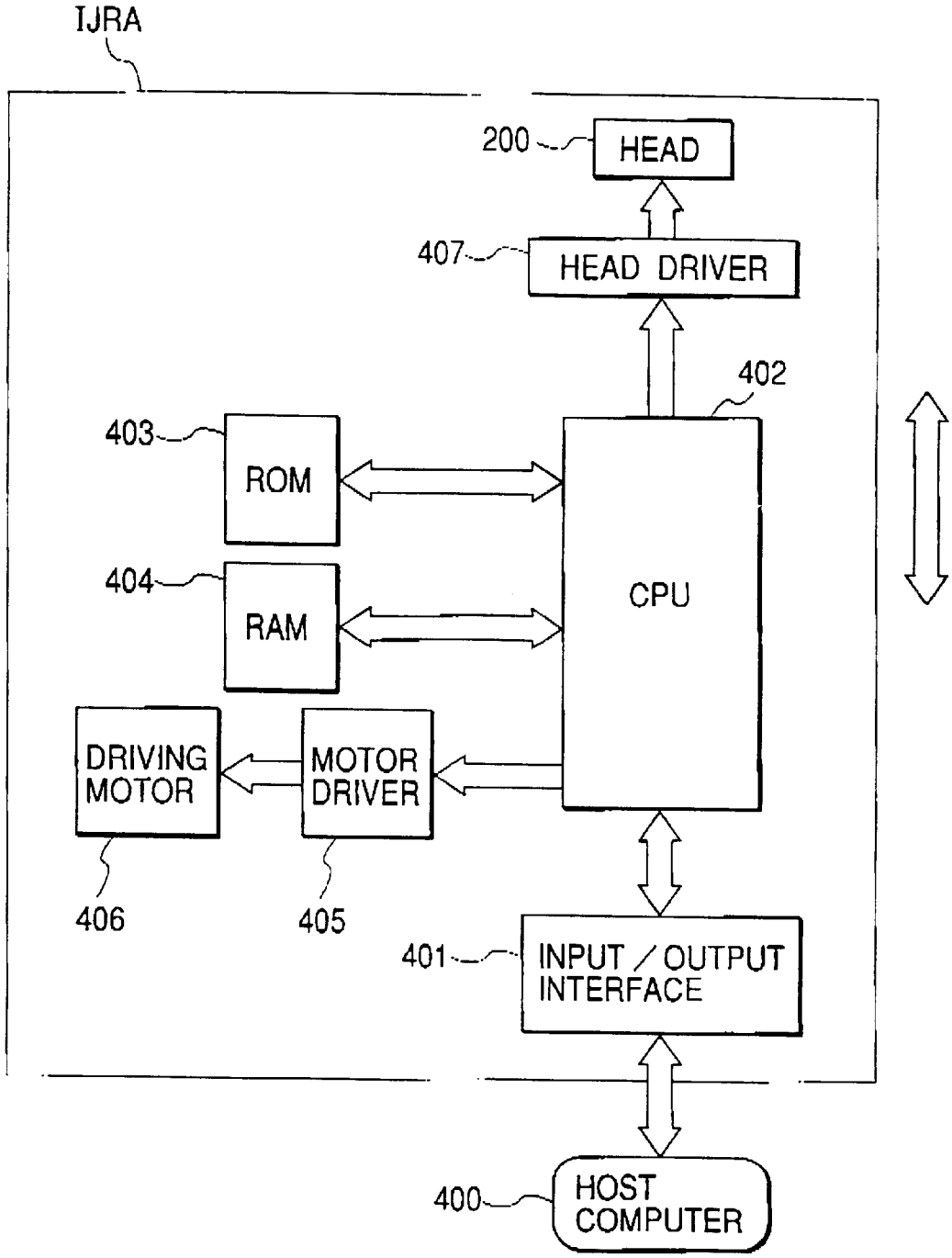
FIG. 6 is a block diagram of the general structure of the ink jet printing apparatus shown in FIG. 5.

FIG. 6 is a block diagram of the general structure of the ink jet printing apparatus for printing images using the above-mentioned ink-jet print head and any one of the ink jet printing methods to be described later.

The ink jet printing apparatus receives print information as a control signal from a printer driver 400 installed in a host computer. The print information is temporarily stored in an input interface 401 inside the ink jet printing apparatus and converted into data capable of being processed in the ink jet printing apparatus. The converted print information is input to a CPU (Central Processing Unit) 402 functioning as head driving-signal supplying means concurrently. Upon receipt of the data, the CPU 402 processes the input data using peripheral units such as a RAM (Random Access Memory) 404 and the like on the basis of a control program stored in a ROM (Read Only Memory) 403 so that the input data will be converted into data to be printed (image data).

The CPU 402 also creates driving data for driving a driving motor 406 which moves the carriage HC with the print head and a printed sheet mounted thereon in synchronization with the image data so that the image data will be printed out in position on the printing sheet. The image data and the motor driving data are transmitted through a head driver 407 and a motor driver 405 to the print head 200 and the driving motor 406, respectively, so that each element will be driven at controlled timing to form an image properly.

The printed medium 150 used in the above-mentioned ink-jet printing apparatus and applied with a liquid such as ink may be any material such as various types of paper or OHP sheet, a compact disk, plastic material for use as a decorative plate or the like, a cloth, metallic material made of aluminum or steel, a cowhide, a pigskin, an artificial leather, wood like timber or plywood, bamboo material, ceramic like a tile, a three-dimensional structure like a sponge, etc.

Further, the ink jet printing apparatus may be a printer for printing images on various types of paper or an OHP sheet, a printer for printing images on plastic material such as a compact disk, a printer for printing images on a metal plate, a printer for printing images on leather, a printer for printing images on wood or lumber, a printer for printing images on ceramic, a printer for printing images on a three-dimensional structure such as a sponge, and a printer for dyeing a cloth or fabric.

Furthermore, the discharged liquid for use with the ink-jet print head may be any type of liquid as long as it suits the printed medium and satisfies the printing conditions.

The above-mentioned ink-jet head and ink jet printing apparatus are also applicable to other embodiments to be described below, and description of the following embodiments uses the same reference numerals or symbols as those used in the above-mentioned embodiment.

It should also be noted that the present invention is not limited to the above-mentioned embodiment as long as it is applied to ink-jet print heads on which image degradation due to satellite dots occurs. For example, the present invention includes a print head having no movable member and a print head having a discharging energy generating element other than the heating element.

Description will be made next of an ink jet printing method according to the embodiment for preventing printed quality degradation due to adherence of satellite dots on the printed medium.

Figure 7:
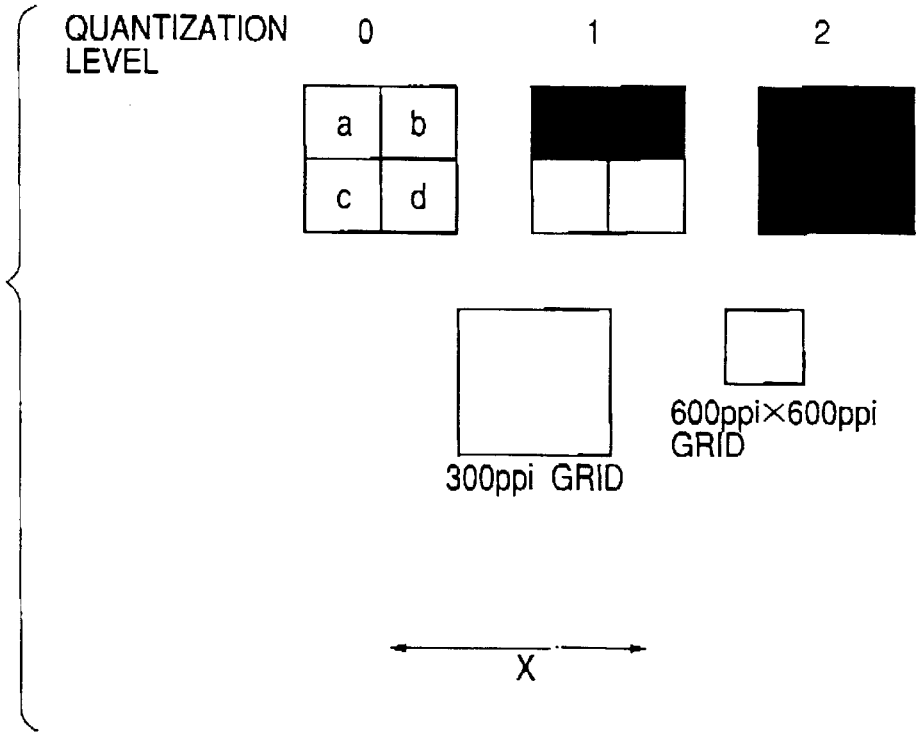
FIG. 7 illustrates matrix patterns created by a matrix printing method practiced as a first embodiment of the present invention.

FIG. 7 illustrates matrix patterns created by a matrix printing method practiced as this embodiment of the present invention.

As disclosed in Japanese Patent Laid-Open Application No. 2000-127459, the matrix printing method transfers relatively low-resolution, high-value quantized, processed image data to a printer main body by means of a printer driver in a host computer. Upon receipt of the image data, the printer main body develops the received image data to print data conforming to a predetermined dot matrix and prints out the print data. This method can reduce the amount of data transmission between the host and the printer while preventing image quality degradation.

FIG. 7 shows a 300 ppi grid with matrix patterns divided according to the printer-side print resolution into four 600-by-600-dpi (horizontal scanning direction X vertical scanning direction) grids to be used by the printer driver for processing on the host computer. The 300 ppi grid is quantized at three levels, that is, the quantization levels include a case where the number of created dotted grids within the 300 ppi grid is zero (level 0), a case where it is two (level 1), and a case where it is four (level 2). Their developed dot patterns are set not to form a single-dot printed grid in the horizontal scanning direction X. Using symbols a through d written in the 300 ppi grid at level 0 to explain this, creation of a single-dotted grid a, b, c and d, and creation of dotted grids a and c, or b and d are prohibited. On the other hand, creation of dotted grids a and b or all of a, b, c and d is allowed. When print information for use in printing onto a printed medium is first print information of a single-dot print, the CPU 402 as the changing means adds second print information for generating no satellite dots continuously after the first print information. In other words, the CPU 402 changes the print information composed of the first print information alone into the print information composed of the first print information and the second print information.

This change in the print information allows a main droplet discharged according to the second print information to be hit on a satellite dot alighted adjacent to but slightly spaced with a main droplet discharged according to the first print information, thereby making the satellite dot inconspicuous.

Figure 8:
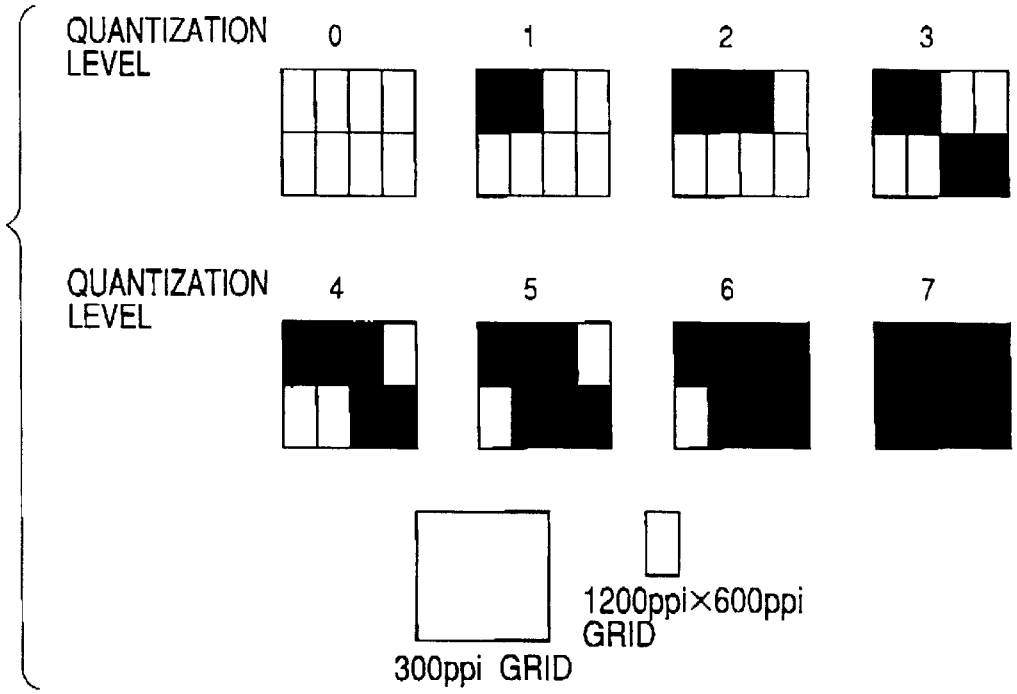
FIG. 8 illustrates other matrix patterns created by the matrix printing method practiced as the first embodiment of the present invention.

FIG. 8 shows a 300 ppi grid with matrix patterns divided according to the printer-side print resolution into eight 1200-by-600-dpi (horizontal scanning direction X vertical scanning direction) grids to be used by the printer driver for processing on the host computer. The 300 ppi grid is quantized at eight levels, from level 0 to level 7. In this case, their developed dot patterns are also set not to form a single-dot printed grid in the horizontal scanning direction X.

In other words, the ink jet printing method according to the embodiment creates print data or dot patterns indicative of such an arrangement that two or more pixels data corresponding to dots hit on the printed medium are always aligned in the horizontal scanning direction at actual printing. Thus the ink jet printing method creates a dot pattern to perform printing on the basis of the dot pattern, so that the satellite dots can be made inconspicuous in single-dot printing, thereby achieving stable, high-quality printing.

It should be noted that although the embodiment described the relationship between processing resolution and actual printing resolution and associated dot patterns, the present invention is not limited to the embodiment.

The following describes a possible modification of the embodiment. In this case, the 300 ppi grid is quantized at more levels, namely four levels. The quantization levels include a case where the number of created dotted grids within the 300 ppi grid is zero (level 0), a case where it is one (level 1), a case where it is two (level 2), and a case where it is four (level 3). Description will be made below using symbols a through d written in the 300 ppi grid at level 0 in FIG. 7, where level 1 contains a dotted grid a, level 2 contains dotted grids a and b, and level 3 contains dotted grids a, b, c and d.

In this case, since the isolated level-one matrix forms an isolated dotted grid, the quantization should be so set that use of the level-one matrix is kept to a minimum. If no level-one matrix is used, this modification will be exactly lie same as the above-mentioned embodiment. Even if the level-one matrix is used, the probability of generation of the level-one matrix can be set extremely low so that use of the level-zero, or level-two or higher matrixes will become dominant, which can also achieve an improvement equivalent to that in the above-mentioned embodiment.

This modification is effective in a case where a common matrix pattern is used for all colors but satellite characteristics are different between colors.

(Second Embodiment)

FIGS. 9A and 9B illustrate dither patterns created by another quantization technique different from that of the first embodiment. Two exemplary patterns shown in FIG. 9 are created to imitate characteristics of a fatting (centralized type) pattern (FIG. 9A) and a Bayer (distributed type) pattern (FIG. 9B), both of which are known as dither patterns, but this embodiment is not limited thereto. Further, FIGS. 9A and 9B each show a four- by four-pixel pattern in the interests of simplicity, in which the numerical values indicate criteria of binary judgment when there are 0 to 16 inputs.

Even in this case, the dither patterns are set so that two or more dots are always aligned in the horizontal scanning direction during actual printing to reduce the influence of satellite dots on image quality degradation. In other words, the patterns are so set that two or more pixels with the same numerical value (for example, pixels with "6" as enclosed with a thick-line box ion FIGS. 9A and 9B) are aligned in the horizontal scanning direction.

In this embodiment, single-dot printing can also be avoided on the print data in the same manner as in the first embodiment. Therefore, image quality degradation due to satellite dots tending to be generated in single-dot printing on the ink-jet print head can be reduced, allowing stable, high-quality printing.

(Third Embodiment)

Description will be made next about the process to create print data for forming continuous dots using error diffusion as still another quantization method different from those of the first and second embodiments.

Figure 10:
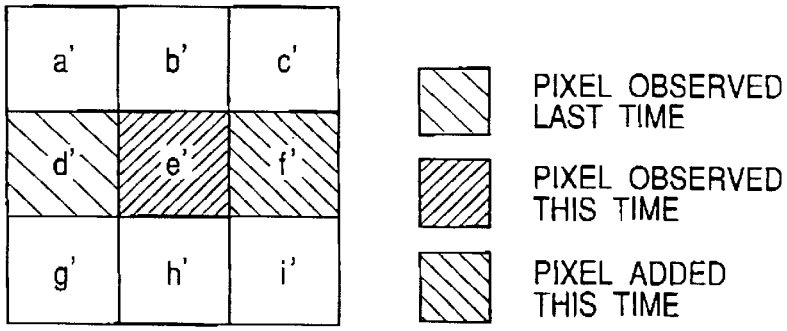
FIG. 10 illustrates related pixels in the process of error diffusion according to a third embodiment of the present invention.

FIG. 10 shows related pixels in the process of error diffusion according to this embodiment. It should be noted that this embodiment illustrates a three- by three-pixel pattern as an example to simplify the explanation.

In FIG. 10, the pixels are given symbols a' to i' as distinguished from one another. Further, a pixel observed last time, a pixel observed this time and a pixel added this time are distinguished from one another by varying hatching types. It should be noted that the pixel observed this time indicates a pixel to be quantized this time. In FIG. 10, the pixels in each row are quantized from left to right (for example, the quantized order is d'–e'–f' in the middle row).

Figure 11A:
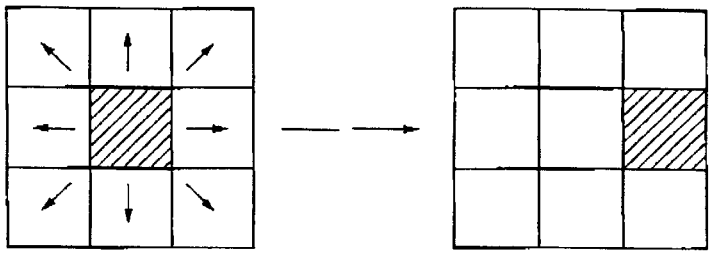
FIGS. 11A, 11B and 11C illustrate a continuous two-dot printing method using error diffusion according to the third embodiment of the present invention.
Figure 11B:
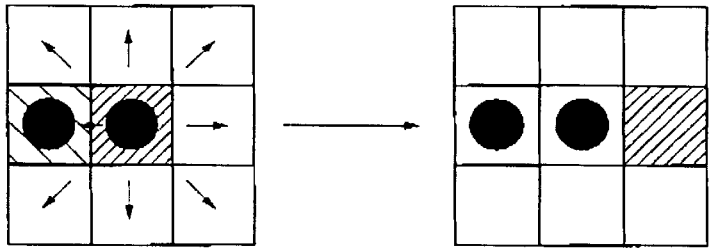
Figure 11C:
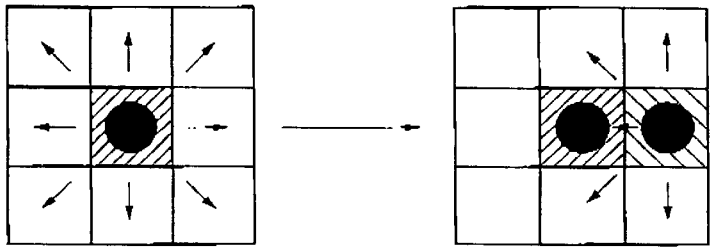
Figure 12:
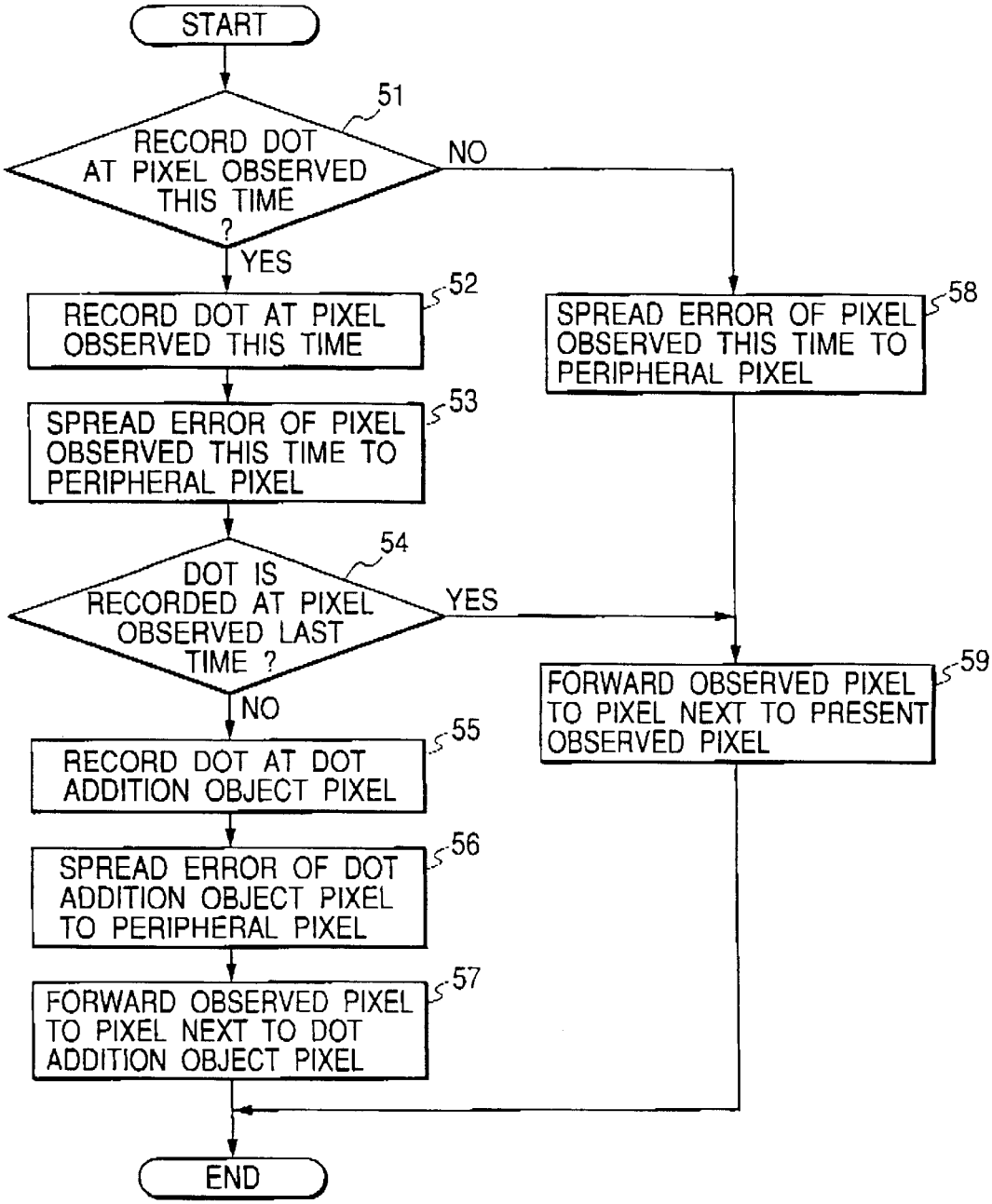
FIG. 12 is a flowchart for explaining the continuous two-dot printing using error diffusion according to the third embodiment of the present invention.

Referring next to FIGS. 11A to 11C and the flowchart of FIG. 12, detailed description will be made about continuous two-dot printing method using error diffusion according to the embodiment. It should be noted that the symbols a' to i' are omitted in FIG. 11 in the interests of simplicity.

At first, a pixel e' observed this time is recognized and quantized by a normal error diffusion technique to leave the printer driver to determine whether the dot should be printed (step 51). As shown in FIG. 11A, if no dot should be printed at the pixel observed, an error is spread to peripheral pixels (step 58). Then the observed pixel is forwarded to the right to a pixel f' (step 59) to process the next pixel.

On the other hand, if the pixel e' observed this time should be printed, a dot is printed at the pixel (step 52) and an error of the pixel observed this time is spread to peripheral pixels (step 53).

It is then determined whether a dot has been printed at the pixel d' observed last time (step 54). As shown in FIG. 11B, if the dot has been printed at the pixel d' observed last time, the observed pixel is forwarded to the pixel f' next to the pixel e' (step 59). As shown in FIG. 11C, if no dot has been printed as the pixel d' observed last time, a dot is printed at the dot addition object pixel f' (step 55). At this time, the dot is forcedly printed regardless of the level of the dot addition object pixel. Further, the dot addition object pixel is processed as if the dot was added to the dot addition object pixel regardless of the level of the dot addition object pixel to spread an error of the dot addition object pixel to peripheral pixels (step 56). Even if the level of the dot addition object pixel is too low to print a dot at the pixel, since the error is stored as a whole, it will have little effect on the printed image. Then the observed pixel is forwarded to a pixel next to the dot addition object pixel (step 57).

Figure 13:
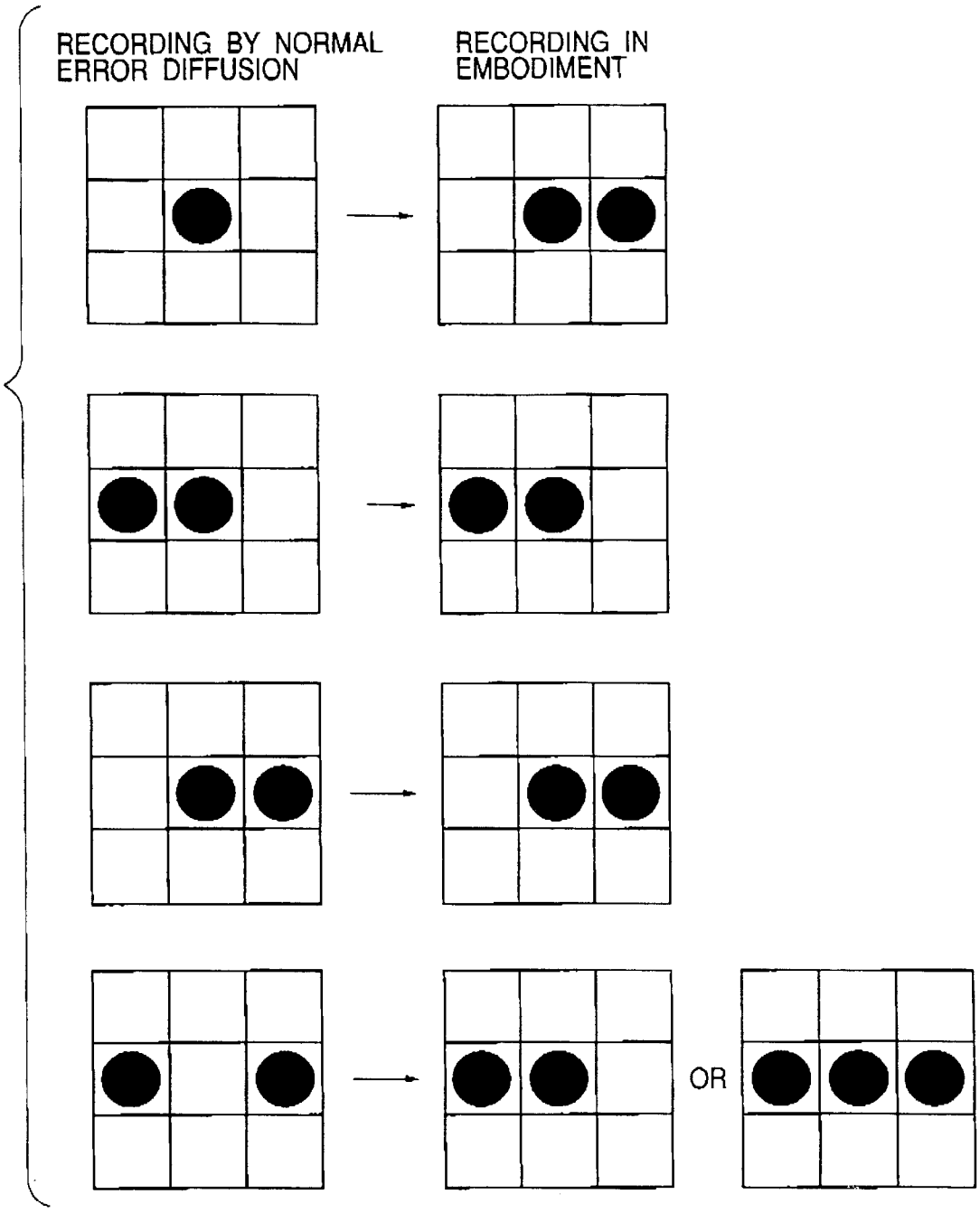
FIG. 13 illustrates examples of continuous two-dot data according to the third embodiment of the present invention.

As a result of the above-mentioned processing, continuous dots are always printed as shown in FIG. 13. Thus the third embodiment can avoid single-dot printing on the print data in the same manner as in the first and second embodiments.

As discussed above and according to the first to third embodiments, two or more continuous dots are generated on the print data, that is, at the stage of quantization for deciding printing positions of the dots, so that a single-dot printing can be avoided. As a result, image quality degradation due to satellite dots tending to be generated in single-dot printing on the ink-jet print head can be reduced, allowing stable, high-quality printing.

(Fourth Embodiment)

Description will be made next about setting of a thinning-out mask for realizing a continuous-dot print in multi-path printing.

The multi-path printing is to prevent image quality degradation due to differences in the amount of discharge between scans on the head or between nozzles in the head, or irregularities in the motion of each nozzle. In other words, the multi-path printing is a known technique for preventing image quality degradation, in which an image is formed through plural nozzles in the head by scanning an image area plural times at the image printing while thinning out the print in each scanning process.

In executing the above-mentioned multi-path printing, continuous two dots are separately printed at adjacent pixels at the multi-path printing even if print data of a continuous two-dot printing type are created, for example, using any one of techniques described in the first to third embodiments. The multi-path printing results in single-dot printing after all, which makes it difficult to use a mechanism for continuously discharging ink from the ink-jet print head having the movable member 11 according to the present invention so that satellite dots will be reduced. Consequently, the effects of the present invention can not be obtained in the multi-path printing process.

Figure 14A:
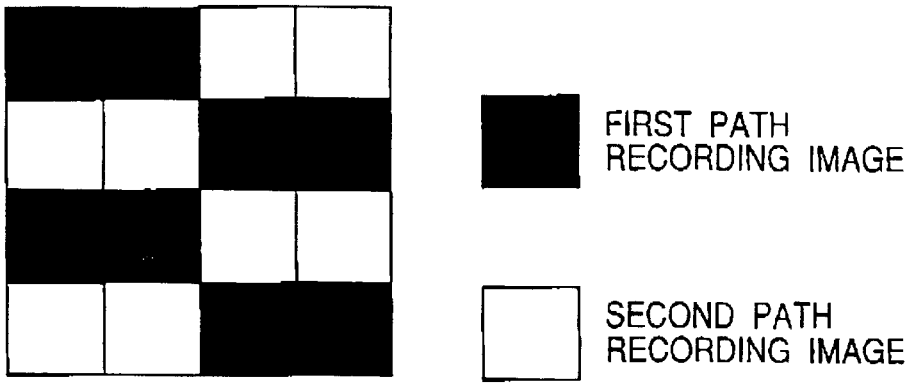
FIGS. 14A and 14B illustrate examples of setting of a thinning-out mask according to a fourth embodiment of the present invention.
Figure 14B:
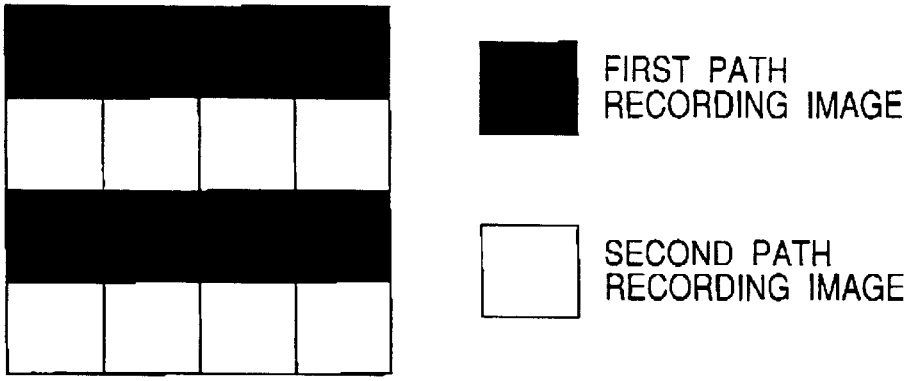

To solve this drawback, a thinning-out mask is used to avoid single-dot printing of the print data of a continuous two-dot printing type at multi-path printing, especially at two-path printing, as shown in FIGS. 14A and 14B.

The pattern shown in FIG. 14A is adaptable to the matrix printing method shown in FIG. 8, or the dither pattern having Bayer characteristics as shown in FIG. 9B. On the other hand, the pattern shown in FIG. 14B is adaptable to the dither pattern having fatting characteristics as shown in FIG. 9A. Both of the patterns shown in FIGS. 14A and 14B are to print two or more continuous dots by continuously discharging ink in each scan period on the basis of a relationship between the dot arrangement of each quantization method and the thinning-out pattern in each multi-path printing process. If the dither pattern having Bayer characteristics shown in FIG. 9B is combined with the thinning-out mask shown in FIG. 14A, continuous two dots are printed at pixels indicated in FIG. 9B with values of judgment 2, 14, 8 and 12 at first-path printing. Then continuous two dots with values of judgment 6, 10, 4 and 16 are printed at second-path printing.

Thus the single-dot printing can be avoided using a combination of print data and a thinning-out mask to print two or more continuous dots less influenced by satellite dots even at multi-path printing, allowing the ink-jet print head to perform stable, high-quality printing with less satellite dots.

The fourth embodiment illustrates the above-mentioned quantization and thinning-out mask combination as an example, but the fourth embodiment is not limited thereto. The fourth embodiment is aimed at correlating setting of the thinning-out mask with any one of the quantization methods described in the first to third embodiments so that generation of a single dot will be prevented. As a result, image quality degradation due to satellite dots tending to be generated in single-dot printing on the ink-jet print head can be reduced, allowing stable, high-quality printing.

(Fifth Embodiment)

Description will be next about a replacement of dots using pattern matching.

The above-mentioned embodiments taught the printing methods for creating and revising necessary data on the printer driver side prior to printing. Unlike the above-mentioned embodiments, this embodiment performs pattern matching of previously created print data to change a dot arrangement so as to realize continuous dots.

At first a description will be made of execution timing of pattern matching when data created by halftoning to contain a single dot are processed by pattern matching.

Figure 15:
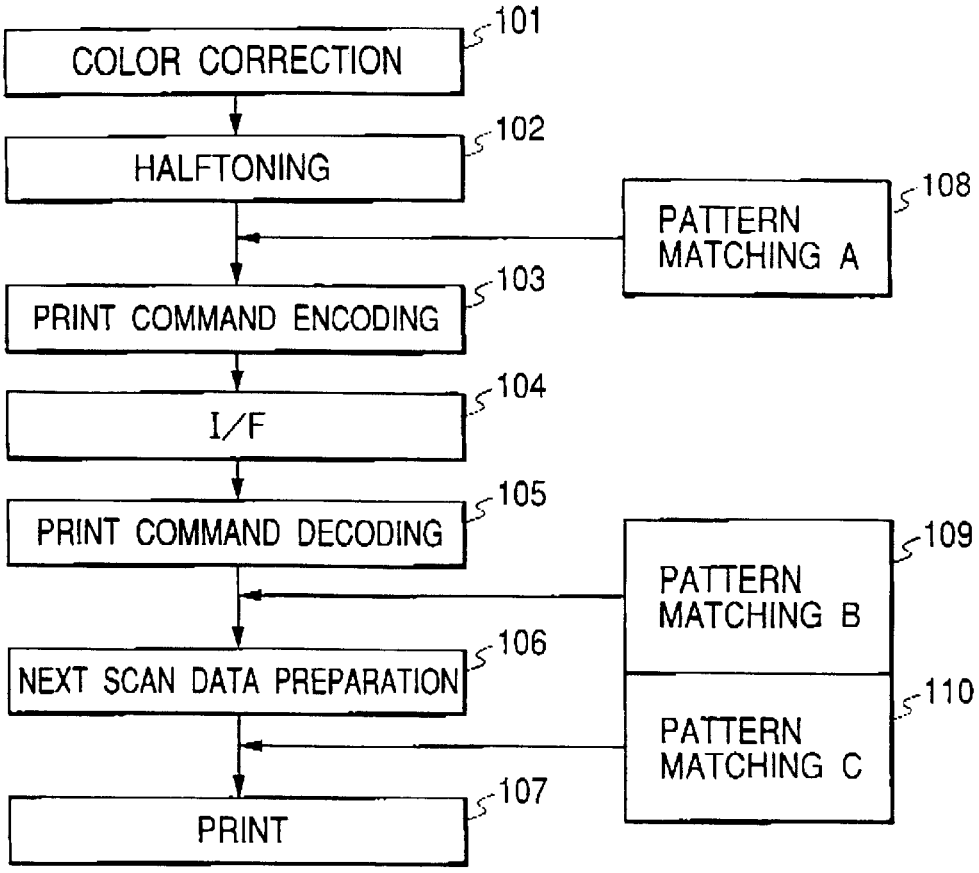
FIG. 15 is a flowchart illustrating timing of executing pattern matching according to a fifth embodiment of the present invention.

FIG. 15 is a flowchart illustrating execution timing of pattern matching when print data created by halftoning are processed by pattern matching according to this embodiment.

At first, the printer driver in the host computer executes color correction (step 101) and halftoning (step 102) to create data containing a single dot. Then the printer driver encodes a print command (step 103). The above-mentioned sequence of operations is carried out by the printer driver 400 in the host computer.

After the data is passed through the I/F interface 401 (step 104), the print command is decoded on the printing apparatus side (step 105) to prepare the printing apparatus for the next scan data (step 106) before printing (step 107).

When the data created to contain a single dot according to normal halftoning procedures as shown in FIG. 15 are processed by pattern matching, the pattern matching could be executed at one of three timings.

Timing A: Execution of Pattern Matching A

Pattern matching A is executed (step 108) after the printer driver 400 in the host computer creates data by halftoning (step 102) and before the printer driver 400 encodes the print command (step 103). In this case, since the printer driver 400 in the host computer executes the pattern matching A, the hardware limitations and load arc kept to a minimum, but the processing speed is relatively low.

Timing B: Execution of Pattern Matching B

Pattern matching B is executed (step 109) after the print command is decoded in the ink jet printing apparatus (step 105) and before the ink jet printing apparatus is prepared for the next scan data (step 106). In this case, if the pattern matching is carried out in an ASIC (Application-Specific Integrated Circuit), the processing speed becomes high enough to increase efficiency. On the other hand, if the pattern matching is carried out by the CPU 402 on the ink jet printer side, the processing speed will depend on the processing speed of the CPU 402. In either case, the processed data need to be stored in a buffer provided inside the ink jet printing apparatus, which causes a high frequency of memory access to increase the processing load.

Timing C: Execution of Pattern Matching C

Pattern matching C is executed (step 110) before the printing is performed (step 107). In this case, since the data are converted at the time they are extracted from the buffer and transferred to the head 200, the processing speed becomes the highest. On the other hand, since this pattern matching is the most hardware-dependent mode, the processing has the least flexibility.

The pattern matching can be executed at any one of the above-mentioned timings depending on characteristics required for the print, such as to decide which assures a higher priority, the processing speed or reduction in the hardware limitations or load.

As discussed above and according to the fifth embodiment, the printing method can not only use conventional printer driver and halftoning techniques as they are, but also retains independence of functions by designing the pattern matching portion as an additional function.

Figure 16:
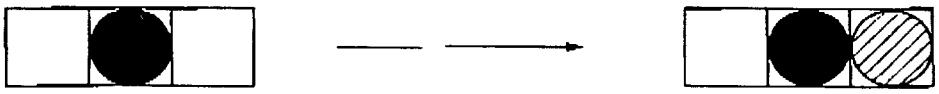
FIG. 16 illustrates an example of a dot added by pattern matching according to the fifth embodiment of the present invention.

Using a one- by three-pixel matrix shown in FIG. 16, the following describes a salient feature of the pattern matching according to the embodiment. The salient feature of the pattern matching according to the embodiment is to replace single-dot data isolated in the horizontal scanning direction with continuous dot data, which is executed at any one of the above-mentioned three timings.

In FIG. 16, the left matrix represents data containing a single dot (black dot) created by halftoning.

If such data as to contain a single dot isolated in the horizontal scanning direction are detected, an additional dot (indicated by a hatched dot) is added in a position next to the single dot as shown in the right matrix in FIG. 16, thus realizing continuous dots. In other words, if a dot arrangement "0-1-0" appears in the horizontal scanning direction, where "0" represents no dot and "1" represents the presence of a dot, the dot arrangement is replaced with a dot arrangement "0-1-1".

FIGS. 17A to 17D illustrate several gray-scale dot patterns of 4- by 4-pixel matrix data, showing how each gray-scale dot pattern is replaced when additional dots are added according to the embodiment. In FIGS. 17A to 17D, the left matrixes represent such data before replacement as to contain at least one single dot, while the right matrixes represent data to which additional dots have been added to replace the single dot with continuous dots.

Figure 17A:
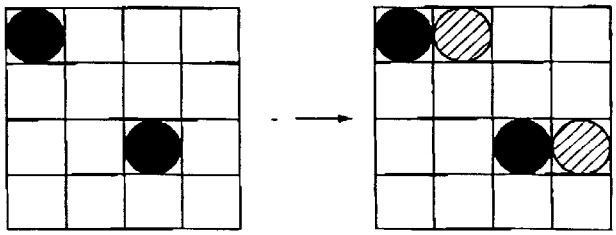
FIGS. 17A, 17B, 17C, and 17D illustrate other examples of dots added by pattern matching according to the fifth embodiment of the present invention.
Figure 17B:
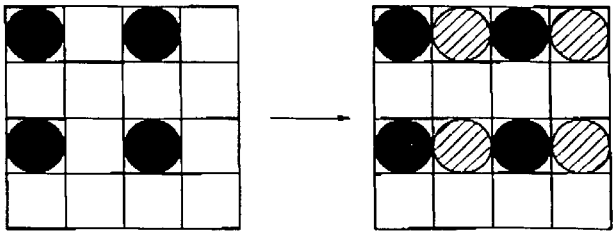

FIGS. 17A and 17B show cases where 12.5%- and 25%-dense data composed of single dots isolated in the horizontal scanning direction are replaced with 25%- and 50%-dense data composed of continuous dots aligned in the horizontal scanning direction, respectively.

Figure 17C:
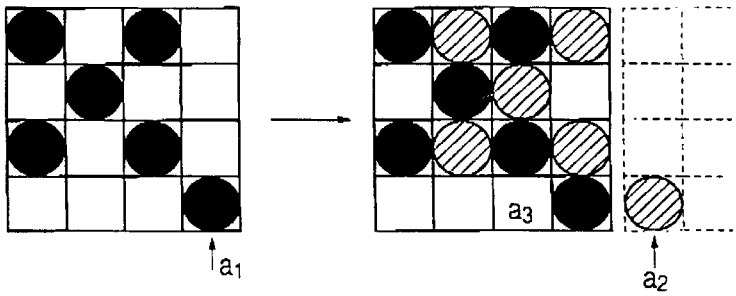

FIG. 17C shows how a single dot (indicated by arrow a1) at the bottom most right end (in the fourth row and the fourth column) of the matrix data before replacement is replaced with continuous dots. In this case, an additional dot may be put in a position indicated by arrow a2 (in the first row and the fourth column) of data to be processed next as indicated by a broken grid, or in a position indicated by arrow a3 (in the third row and the fourth column) of the currently processed matrix data.

Figure 17D:
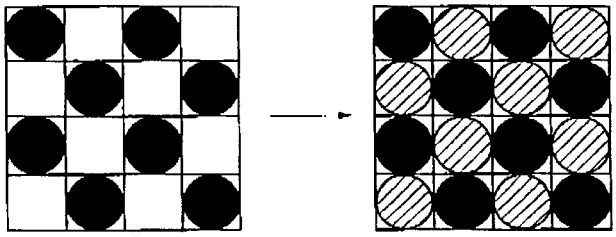

FIG. 17D shows a case where 50%-dense data are patterned by halftoning in a zigzag manner. Since the data are replaced with a 100% solid pattern, the actual image may be cut in gray scale by about 50 percent. In this case, although necessary processing such as creation of print image data and adjustment of density should be performed on the printer driver side, the embodiment does not refer to these techniques.

As discussed above and according to the fifth embodiment, data created by halftoning to contain at least one single dot are replaced with continuous dot data created not to contain any single dot by means of the pattern matching according to the embodiment. Since single-dot printing is avoided on the print data, image quality degradation due to satellite dots tending to be generated in single-dot printing on the ink-jet print head can be reduced, allowing stable, high-quality printing.

Although in the embodiment the pattern matching is executed on a bit basis, the present invention is not limited thereto.

As a modification, the embodiment can be applied to a matrix pattern on a quantized-grid basis. A description will be made here of a case where a 300 ppi grid is divided into four quantization levels. In other words, the quantization levels include the case where the number of created dotted grid to the 300 ppi grid is zero (level 0), the case where it is one (level 1), the case where it is two (level 2), and the case where it is four (level 3). Using symbols a through d written in the 300 ppi grid at level 0 in FIG. 7 to describe their developed patterns, level 1 contains a dotted grid a, level 2 contains dotted grids a and b and level 3 contains dotted grids a, b, c and d.

In this modification, it such data that the matrix levels are aligned as "0-1-0" in the horizontal scanning direction are detected, the isolated level-one matrix will be replaced with the level-two matrix. In this case, the arrangement of the matrix levels becomes "0-2-0" and continuous dotted grids are obtained.

Even when the pattern matching is executed for each matrix level according to this modification, the pattern matching can be carried out at any one of three timings similar to those in the embodiment. Like in the embodiment, the pattern matching can be executed at any one of the above-mentioned three timings depending on characteristics required for the print, such as to decide which assumes a higher priority, the processing speed or reduction in the hardware limitations or load.

Further, the method of detecting single-dot data for each matrix level described in this modification can be combined with the dot adding method described in the embodiment to realize continuous-dot data in the same manner.

(Sixth Embodiment)

Description will be made next about another pattern matching technique in which continuous dots are realized by moving single dots as well as addition of additional dots.

Figure 18A:
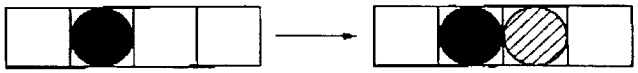
FIGS. 18A and 18B illustrate examples of dots added by pattern matching according to a fix embodiment of the present invention.
Figure 18B:
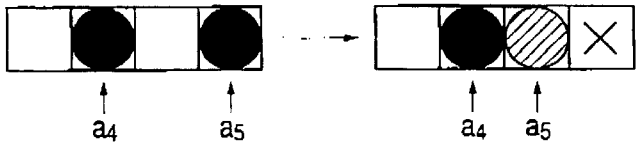

For example, as shown in FIG. 18A, if data are created by halftoning to contain a single dot, an additional dot can be put in a position next to the signal dot to create continuous dot data in the same manner described in the fifth embodiment. On the other hand, if data contains single dots aligned as shown in FIG. 18B, the single dot data located at the right end will be eliminated (as crossed out in FIG. 18B). Then additional dot data are added to the left of the other single dot data (that is, the newly crated dot a5 is put to the left of the previously created dot a4) to create continuous dot data. In other words, this embodiment is such that if dots are aligned as "0-1-0-1" in the horizontal scanning direction, the dots will be realigned as "0-1-1-0." In this case, since one of the dots is moved without adding any additional dot, the number of dots does not increase. As a result, the density of the replaced data does not vary from that of the data before replacement.

FIGS. 19A to 19H illustrate several gray-scale dot patterns of 4- by 4-pixel matrix data, showing how each gray-scale dot pattern is replaced by the pattern matching according to the embodiment. In FIGS. 19A to 19H, the left matrixes represent such data before replacement as to contain at least one single dot, while the right matrixes represent data after additional dots have been added by the pattern matching so that the single dot would be replaced with continuous dots.

Figure 19E:
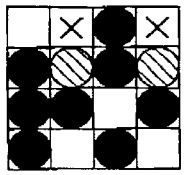
FIGS. 19A, 19B, 19C, 19D, 19E, 19F, 19G and 19H illustrate other examples of dots added by pattern matching according to the sixth embodiment of the present invention.
Figure 19F:
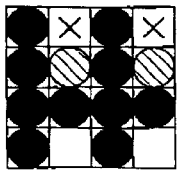
Figure 19G:
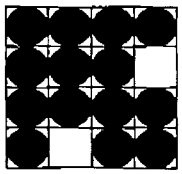
Figure 19H:
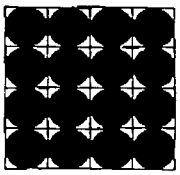
Figure 19A:
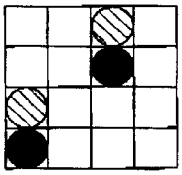

As shown in FIG. 19A, if a single dot is contained in a line (in the horizontal scanning direction), an additional dot is so added that both dots are made continuous in the same manner as described in the fifth embodiment. In this case, since single dots at highlight pixels are replaced with continuous dots, although the density of these pixels become high, the printer driver can adjust the gray scale for the density variations to reduce variations in the number of levels of gray.

Figure 19B:
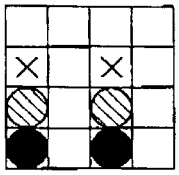

As shown in FIG. 19B, if two single dots are placed at every other pixel in a line (in the horizontal scanning direction), the right single dot data will be eliminated while adding additional dot data to the left of the eliminated dot data. Thus the continuous dot data are obtained.

Figure 19C:
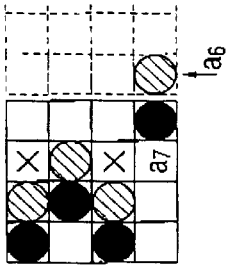

As shown in FIG. 19C, if a single dot is placed at the bottommost right end (in the fourth row and the fourth column) of the data before replacement, an additional dot will be added in the same manner described in the fifth embodiment. In other words, the additional dot may be put in a position indicated by arrow a6 (in the first row and the fourth column) of data to be processed next, or in a position indicated by arrow a7 (in the third row and the fourth column) of the currently processed matrix data.

Figure 19D:
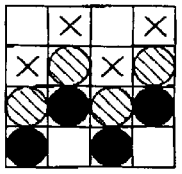

FIG. 19D shows a case where 50%-dense data arc patterned in a zigzag manner. In this case, the single dot located at the right end in each line is moved to the left adjacent pixel, which makes it possible to maintain the density of 50 percent.

In other cases as shown in FIGS. 19E and 19F, the same processing as described in FIG. 19D is performed to maintain the density before replacement.

If no single dot exists as shown in FIGS. 19G and 19H, no replacement will be required because there is no need to consider the effect of the satellite dots.

The above-mentioned pattern matching may also be carried out at any one of the three timings described in the fifth embodiment in connection with FIG. 15.

As discussed above and according to the sixth embodiment, data crated by halftoning to contain at least one single dot in the same manner as in the fifth embodiment are replaced with continuous dot data created not to contain any single dot using the pattern matching according to the embodiment. Since single-dot printing is avoided on the print data, image quality degradation due to satellite dots tending to be generated in single-dot printing on the ink-jet print head can be reduced, allowing stable, high-quality printing.

Further, if the pattern matching according to the embodiment is executed by merely moving dots without adding any additional dots, the number of dots does not increase, and therefore printing can be made without varying the density of data.

(Seventh Embodiment)

Each of the above-mentioned embodiments described the printing method for creating and revising necessary data on the printer driver side prior to printing, or the printing method for executing pattern matching to data created to contain a single dot or dots to change the dot arrangement so as to realize continuous dots. Unlike the above-mentioned embodiments, this embodiment illustrates a control method for the print head to achieve appropriate printing without changing print image data.

The control method in the embodiment is implemented in a combination of the following features, that is, by giving the following functions to the CPU 402 of the ink jet printing apparatus shown in FIG. 5:

(1) A function for counting the number of continuous discharged dots for each nozzle;

(2) A function for judging whether the count value for the pixel concerned is one; and (3) A function for controlling the nozzle concerned to discharge ink at a pixel next to the pixel concerned without fail when the judgment result is affirmative.

In this configuration, a control signal is sent to the head driver 407 to drive the print head 200. Thus the head is controlled in a manner which corresponds to the pattern matching described in the fifth embodiment. In other words, even if printing is performed on the basis of data created to contain a single dot or dots isolated in the horizontal direction, the head is controlled so that it discharges ink to a pixel or pixels next to the single dot or dots. This makes it possible to form continuous dots on the printed medium.

Further, to control the head in a manner which corresponds to the pattern matching described in the sixth embodiment, that is, in a manner which corresponds to data replacement shown in FIG. 18B, the CPU 402 further includes the following function in addition to the above-mentioned functions:

(4) A function for controlling the nozzle concerned not to discharge ink at a pixel next to the pixel concerned after completion of the above-mentioned processing step 3.

Of all the above-mentioned functions of the CPU 402, the function (3) may be replaced with:

(3') A function for generating a further one-dot discharging pulse to the nozzle concerned in addition to the normal discharging pulse when the judgment result is affirmative.

In other words, the same nozzle from which the single dot has been formed is controlled to form a dot at a pixel next to the single dot so that continuous dots will be formed. In this case, the continuous dots are formed earlier than in the normal discharging period. The earlier discharge makes the additional dot hit at a position closer to the first dot, which makes it possible to reduce image quality degradation accompanied with noticeable granularity.

As discussed above and according to the seventh embodiment, the head can be controlled to form continuous dots without any single dot without the need to change the print image data. Consequently, image quality degradation due to satellite dots tending to be generated in single-dot printing on the ink-jet print head can be reduced, allowing stable, high-quality printing.

(Eighth Embodiment)

Description will be made next about a printing method capable of reducing granularity by using single dots and continuous dots properly according to this embodiment.

In a practical printing system, for example, at such multi-path printing that a raster is scanned two or more times, satellite dots may be conspicuous when scanning forward and inconspicuous when scanning backward. Such irregularities of generation of satellite dots can occur because of the relationship between the discharging angle from the ink-jet print head to the paper surface and the scanning speed of the carriage. To reduce granularity in highlight portions, this embodiment positively uses single dots in one scanning direction in which the satellite dots are inconspicuous.

Figure 20A:
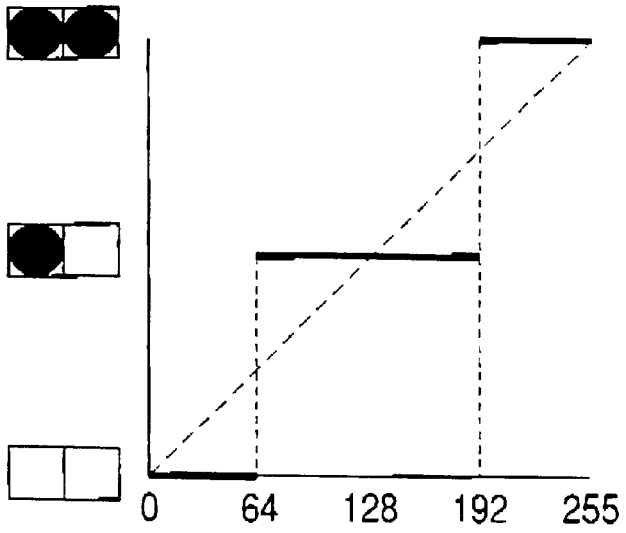
FIGS. 20A and 20B illustrate quantization levels when single-dot printing and continuous dot printing are used properly according to an eighth embodiment of the present invention.
Figure 20B:
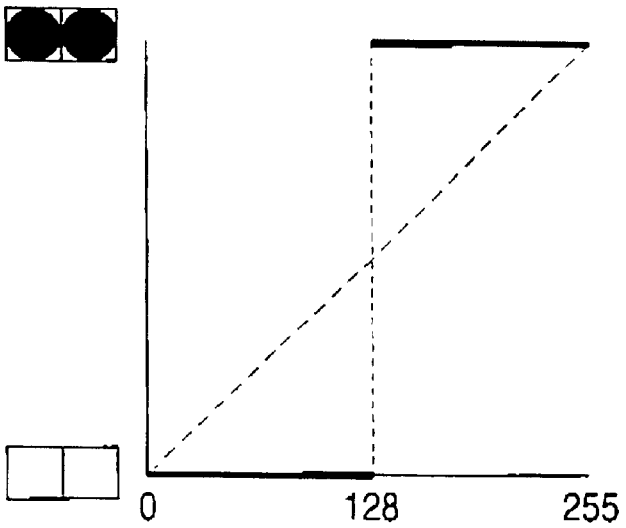

FIGS. 20A and 20B illustrate a first technique according to the embodiment. As shown in FIGS. 20A and 20B, the first technique sets the following quantization levels:

Satellite-inconspicuous scanning direction: Ternary quantization levels (FIG. 20A)

Satellite-conspicuous scanning direction: Binary quantization levels (FIG. 20B)

When scanning is on the way, since satellite dots are inconspicuous, quantization is carried out at three levels, that is, in ternary, so that single dots are formed in highlight portions, thereby reducing granularity. On the other hand, when scanning is on the way back, since satellite dots become conspicuous, all dots are formed in binary, that is, either "0 dots" or "2 dots", to solve the satellite problems.

Using the processing for changing "single dots" to "consecutive dots" described in the above-mentioned embodiments, a second technique according to the embodiment is to perform selective processing as follows:

Satellite-inconspicuous scanning direction: "Single dots" to "consecutive dots" processing not applied.

Satellite-conspicuous scanning direction: "Single dots" to "consecutive dots" processing applied.

Such selective processing allows satellite dots to be cancelled while reducing granularity in highlight portions.

A third technique according to the embodiment sets the following pseudo shades:

Satellite-inconspicuous scanning direction: light dots

Satellite-conspicuous scanning direction: dark dots

Such an arrangement that only the pseudo "light dots" are put in the highlight portions would also be effective in reducing granularity. In this case, lights and shades can be processed by any known technique.

(Ninth Embodiment)

The eighth embodiment illustrated the printing method for positive use of single dots to reduce granularity. On the other hand, this embodiment illustrates a printing method for positive use of satellite dots to reduce granularity.

In other words, the embodiment is to reduce granularity using a tendency of satellite dots to be hit far away from main droplets at such high-speed printing that the carriage HC is moved at high speed.

Figure 21A:
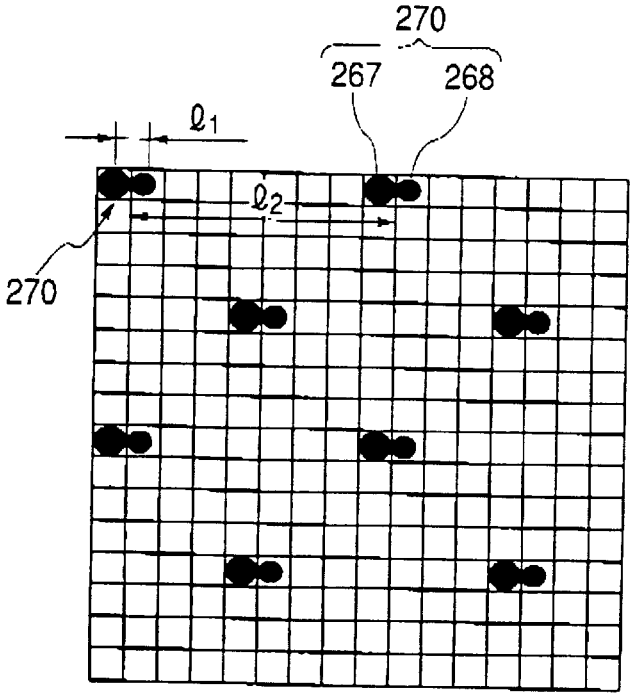
FIGS. 21A and 21B illustrate hitting positions of main and satellite droplets in both cases where printing is made by moving a carriage at low and high speeds.
Figure 21B:
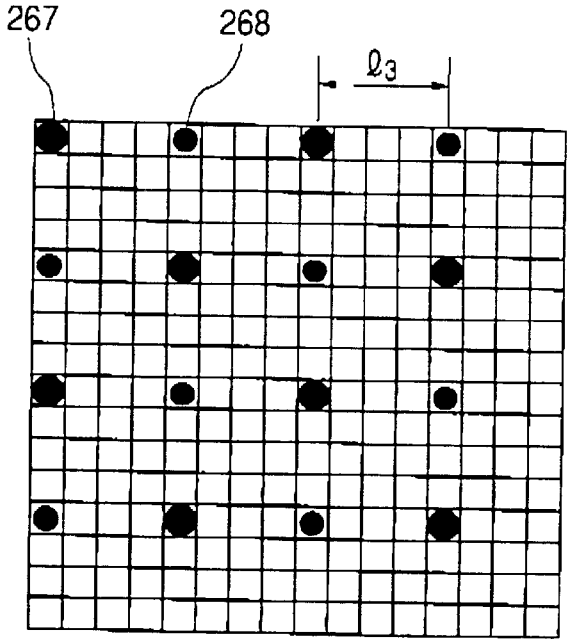

FIG. 21A shows hitting positions of main droplets and satellite dots at such low-speed printing that the carriage HC is moved at low speed. FIG. 21B shows hitting positions of main droplets and satellite dots at such high-speed printing that the carriage HC is moved at high speed.

Distance $l_1$ between a main droplet 267 and a satellite dot 268 at low-speed printing shown in FIG. 21A is much shorter than distance $l_3$ between the main droplet 267 and the satellite dot 268 at high-speed printing shown in FIG. 21B. The distance $l_1$ at low-speed printing is short enough, that is, the main droplet 267 and the satellite dot 268 are hit closer to each other enough to be regarded as one droplet. When the main droplet 267 and the satellite dot 268 are regarded as one droplet, distance $l_2$ between main-satellite droplets 270 becomes longer than the distance $l_3$ between the main droplet 267 and the satellite dot 268 at high-speed printing.

To be more specific, if the main droplet 267 and the satellite dot 268 are hit closer to each other at low-speed printing enough to be regarded as one droplet, such united large droplets will be arranged relatively far away from each other. On the other hand, if the main droplet 267 and the satellite dot 268 are hit far away from each other at high-speed printing, they will form an image as respective small dots as if to imitate the operations of a head having a small amount of discharge.

It is assumed that the size of the main droplet relative to the satellite dot is 2:1 in FIGS. 21A and 21B. If granularity is approximated by (discharge amount of each dot X mean distance between dots), the proportion of granularity at low-speed printing to granularity at high-speed printing is determined as:

Granularity at low-speed printing: Granularity at high-speed printing=(3×1.41421356): 1.5×1=3:1

In other words, high-speed printing wherein the carriage HC is moved at high speed can reduce granularity by about one-third of granularity obtained at low-speed printing where the carriage HC is moved at low speed.

In the case that satellite dots are always hit far away from droplets, the quality of an image such as a text or a fine lines must be considerably degraded to degrade the total image quality. Even in this case, as described in the above-mentioned embodiments, processing for discharging at least two continuous dots can used to eliminate satellite dots.

If the processing for discharging at least two continuous dots is performed to the following areas while using satellite dots on the other areas to reduce granularity, the total image quality can be improved:

1. Black/color text areas
2. Fine-line/vector-image areas
3. Right-and-left end areas of a photographic image or the like in the horizontal scanning direction
4. Vicinities of extremely dense pixels in a photographic image or the like
5. Other high contrast areas in the horizontal scanning direction This technique also features improvement of image quality together with the improvement of printing speed resulting from speed-up of the movement of the carriage.

(Tenth Embodiment)

Description will be made next about a printing method for positive use of satellite dots to improve image quality in gray-scale printing.

In gray-scale printing, light ink tends to be used in highlight portions of a landscape or the like. In this case, satellite dots are simply used in the entire area to reduce granularity.

On the other hand, dark ink is mostly dotted in areas already formed with the light-color ink in the landscape. If only the dark-color ink is used to form an image, the image can mostly be color characters. In this case, the processing for discharging at least two continuous dots can be always performed to eliminate satellite dots.

The relation between light and shade can be replaced with the relation between black and color on the basis of the same theory. In other words, if an image is dotted with color ink, satellite dots are simply used in the entire area to reduce granularity. On the other hand, if an image is dotted with black ink, the processing for discharging at least two continuous dots can be always performed to eliminate satellite dots.

This can eliminate the need for image judgment or the like to turn the processing On and Off, which makes it possible to obtain the optimum image quality almost all the areas from highlight portions to the densest portions in simple On/Off operations of the processing for each color.

Although the above-mentioned first through seventh embodiments described the data processing for making satellite dots incognizable, the positive use of satellite dots described in the eight through tenth embodiments can be obtained on the basis of the processing for making satellite dots incognizable described in the first through seventh embodiments. In other words, the On/Off operations of the processing described in the first through seventh embodiments can make satellite dots incognizable or leave satellite dots as they are. If satellite dots run the danger of reducing the printed quality, the processing described in the first through seventh embodiments can be turned on to make the satellite dots incognizable. On the other hand, if satellite dots are positively used to reduce granularity, the processing described in the first through seventh embodiments will be turned off.

(Eleventh Embodiment)

Description will be made next about a technique for improving granularity expected to be degraded by printing highlight portions using the processing for at least two continuous dots, especially for improving granularity of an image dotted with black ink.

If an image is dotted with black ink, though depend on the system design, the following characteristics are generally expected.

1. Black ink is designed to be discharged by larger amount than color ink is.
2. Even if the amount of discharge is the same, the densest ink forms the roughest granular image.

These characteristics may run the danger of reducing granularity during the processing for at least two continuous dots described in the first through seventh embodiments.

To avoid this, process black (composite black) formed of color inks such as cyan, magenta, yellow and the like, is used in highlight to light portions instead of black ink. The process black is created from color inks smaller in the amount of discharge and lower in the density than the black ink, so that it can reduce granularity compared to the black ink. It is preferable to start printing with black ink after the process black is made dense enough for use as black ink.

The idea of "use of process black to reduce granularity of black ink" is not new, but a combination of the process black with the processing for at least two continuous dots described in the above-mentioned embodiments will especially work wonders.

What is claimed is:

1. An ink jet printing system comprising an ink jet head from which ink is discharged to print an image on a recording medium, an ink jet apparatus provided with conveying means for conveying the recording medium and holding means for holding and scanning the ink jet head in a main or horizontal scanning direction intersecting a conveying direction of the recording medium, and a printer driver for creating image information to be output to the ink jet apparatus on the basis of density information, said ink jet printing system comprising:

image information detecting means for receiving first image information to detect whether the first image information represents an image prone to significant degradation due to detrimental effects of satellite dots; and image information changing means for changing image information to be used, if said image information detection means detects that the first image information represents an image prone to significant degradation due to detrimental effects of satellite dots, from the first image information to second image information representing an image less influenced by the satellite dots than that represented by the first image information.

2. The system according to claim 1, wherein said image information detecting means and said image information changing means are provided in said printer driver.

3. The system according to claim 1, wherein said image information detecting means and said image information changing means are provided in said ink jet apparatus.

4. The system according to claim 1, wherein said image information detecting means and said image information changing means are provided in said ink jet head.

5. The system according to claim 1, wherein the image information that represents an image prone to significant degradation due to detrimental effects of satellite dots is image information representing one or more separated dots.

6. The system according to claim 5, wherein the second image information that represents and image less influenced by the satellite dots is image information representative of an image formed with continuous dots.

7. The system according to claim 1, wherein the first image information is unit-area gradation information indicative of levels of gray in a unit area on the recording medium.

8. The system according to claim 1, wherein the first image information is discharge data for driving said ink jet head.

9. The system according to claim 1, wherein the second image information is discharge data for driving said ink jet head.

10. The system according to claim 1, wherein the second image information is a driving pulse for driving said ink jet head.

11. The system according to claim 1, wherein the second image information is unit-area gradation information indicative of levels of gray in a unit area on the recording medium.

12. The system according to claim 1, wherein said ink jet head includes a heating element for generating thermal energy for generating a bubble in ink.

13. The system according to claim 12, wherein said ink jet head includes a movable member having a free end provided in a bubble generating region for generating the bubble in the ink in an ink flow path communicating with a discharge port, and displaced with the growth of the bubble.

14. An ink jet printing method for creating image information from density information, driving an ink jet head on the basis of the image information, and discharging ink to a recording medium to form an image on the recording medium, said method comprising the steps of:

receiving first image information to detect whether the first image information represents an image prone to significant degradation due to detrimental effects of satellite dots; and changing image information to be used, if detected that the first image information represents an image prone to significant degradation due to detrimental effects of satellite dots, from the first image information to second image information representing an image less influenced by satellite dots than that represented by the first image information.

15. The method according to claim 14, wherein the first image information is unit-area gradation information indicative of levels of gray in a unit area on the recording medium.

16. The method according to claim 14, wherein the first image information is discharge data for driving the ink jet head.

17. The method according to claim 14, wherein the image information that represents an image prone to significant degradation due to detrimental effects of satellite dots is image information representing one or more separated dots.

18. The method according to claim 17, wherein the second image information that represents an image less influenced by the satellite dots is image information representative of an image formed with continuous dots.

19. The method according to claim 14, wherein the second image information is discharge data for driving the ink jet head.

20. The method according to claim 14, wherein the second image information is a driving pulse for driving the ink jet head.

21. The method according to claim 14, wherein the second image information is unit-area gradation information indicative of levels of gray in a unit area on the recording medium.

22. An ink jet printing system comprising an ink jet head from which ink is discharged to print an image on a recording medium, an ink jet apparatus provided with conveying means for conveying the recording medium and holding means for holding and scanning the ink jet head in a main or horizontal scanning direction intersecting a conveying direction of the recording medium, and a printer driver for creating image information to be output to the ink jet apparatus on the basis of density information, said ink jet printing system comprising:

image information generating means for receiving first image information and generating second image information that reduces the frequency of generation of image degradation caused by the first image information.

* * * * *

UNITED STATES PATENT AND TRADEMARK OFFICE

CERTIFICATE OF CORRECTION

PATENT NO. : 6,612,678 B2
DATED : September 2, 2003
INVENTOR(S) : Kato et al.

It is certified that error appears in the above-identified patent and that said Letters Patent is hereby corrected as shown below:

Column 6,
Line 27, “o fink” should read -- of ink --.

Column 10,
Line 7, “bat” should read -- but --; and
Line 40, “IIC” should read -- HC --.

Column 15,
Line 63, “arc” should read -- are --.

Column 18,
Line 43, “arc” should read -- are --.

Signed and Sealed this

Ninth Day of March, 2004

JON W. DUDAS
*Acting Director of the United States Patent and Trademark Office*